US010054277B2

(12) United States Patent
Horiba

(10) Patent No.: US 10,054,277 B2
(45) Date of Patent: Aug. 21, 2018

(54) VEHICLE LAMP

(71) Applicant: KOITO MANUFACTURING CO., LTD., Minato-ku, Tokyo (JP)

(72) Inventor: Takeshi Horiba, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 15/511,137

(22) PCT Filed: Sep. 3, 2015

(86) PCT No.: PCT/JP2015/075108
§ 371 (c)(1),
(2) Date: Mar. 14, 2017

(87) PCT Pub. No.: WO2016/043059
PCT Pub. Date: Mar. 24, 2016

(65) Prior Publication Data

US 2017/0261172 A1 Sep. 14, 2017

(30) Foreign Application Priority Data

Sep. 16, 2014 (JP) ..... 2014-187409
Sep. 16, 2014 (JP) ..... 2014-187410

(51) Int. Cl.
*F21S 41/663* (2018.01)
*F21S 8/10* (2006.01)
(Continued)

(52) U.S. Cl.
CPC ..... *F21S 41/663* (2018.01); *F21S 41/32* (2018.01); *F21S 41/60* (2018.01);
(Continued)

(58) Field of Classification Search
CPC . F21S 48/1747; F21S 48/1317; F21S 48/1705
See application file for complete search history.

(56) References Cited

U.S. PATENT DOCUMENTS 7,387,417 B2 * 6/2008 Sazuka ..... B60Q 1/0041 362/544
8,690,405 B2 * 4/2014 Sekiguchi ..... F21V 13/12 362/514
(Continued)

FOREIGN PATENT DOCUMENTS

JP 2004-303639 A 10/2004
JP 2004-342574 A 12/2004
(Continued)

OTHER PUBLICATIONS

International Search Report dated Dec. 8, 2015 issued by International Searching Authority in counterpart International Application No. PCT/JP2015/075108 (PCT/ISA/210).
(Continued)

*Primary Examiner* — Mary Ellen Bowman
(74) *Attorney, Agent, or Firm* — Sughrue Mion, PLLC

(57) ABSTRACT

A vehicle lamp is configured to be able to selectively perform low-beam irradiation and high-beam irradiation. The vehicle lamp includes first and second light-emitting elements and a reflector for reflecting light emitted from these first and second light-emitting elements toward a front. A reflecting surface of the reflector has a first reflection region on which light emitted from the first light-emitting element is incident and a second reflection region on which light emitted from the first light-emitting element is not incident but light emitted from the second light-emitting element is incident. A low-beam light distribution pattern having horizontal and oblique cutoff lines is formed by turning on the first light-emitting element. A high-beam light distribution pattern is formed by turning on the second light-emitting element or simultaneously turning on the first and second light-emitting elements.

10 Claims, 15 Drawing Sheets

(51) Int. Cl.
*F21S 41/60* (2018.01)
*F21S 41/32* (2018.01)

(52) U.S. Cl.
CPC ..... *F21S 48/1317* (2013.01); *F21S 48/1705* (2013.01); *F21S 48/1747* (2013.01)

(56) References Cited

U.S. PATENT DOCUMENTS

| | | | | |
|---|---|---|---|---|
| 2004/0213014 | A1 | 10/2004 | Koike | |
| 2004/0223338 | A1 | 11/2004 | Koike et al. | |
| 2004/0252517 | A1 | 12/2004 | Ishida et al. | |
| 2005/0068787 | A1* | 3/2005 | Ishida ..... | B60Q 1/14 362/538 |
| 2014/0340924 | A1* | 11/2014 | Matsumoto ..... | F21S 48/1388 362/518 |

FOREIGN PATENT DOCUMENTS

| | | | | |
|---|---|---|---|---|
| JP | 4335621 | B2 | | 9/2009 |
| JP | 2011-181418 | A | | 9/2011 |
| JP | 2011181418 | A | * | 9/2011 |
| JP | 2012-59675 | A | | 3/2012 |

OTHER PUBLICATIONS

Written Opinion dated Dec. 8, 2015 issued by International Searching Authority in counterpart International Application No. PCT/JP2015/075108 (PCT/ISA/237).

* cited by examiner

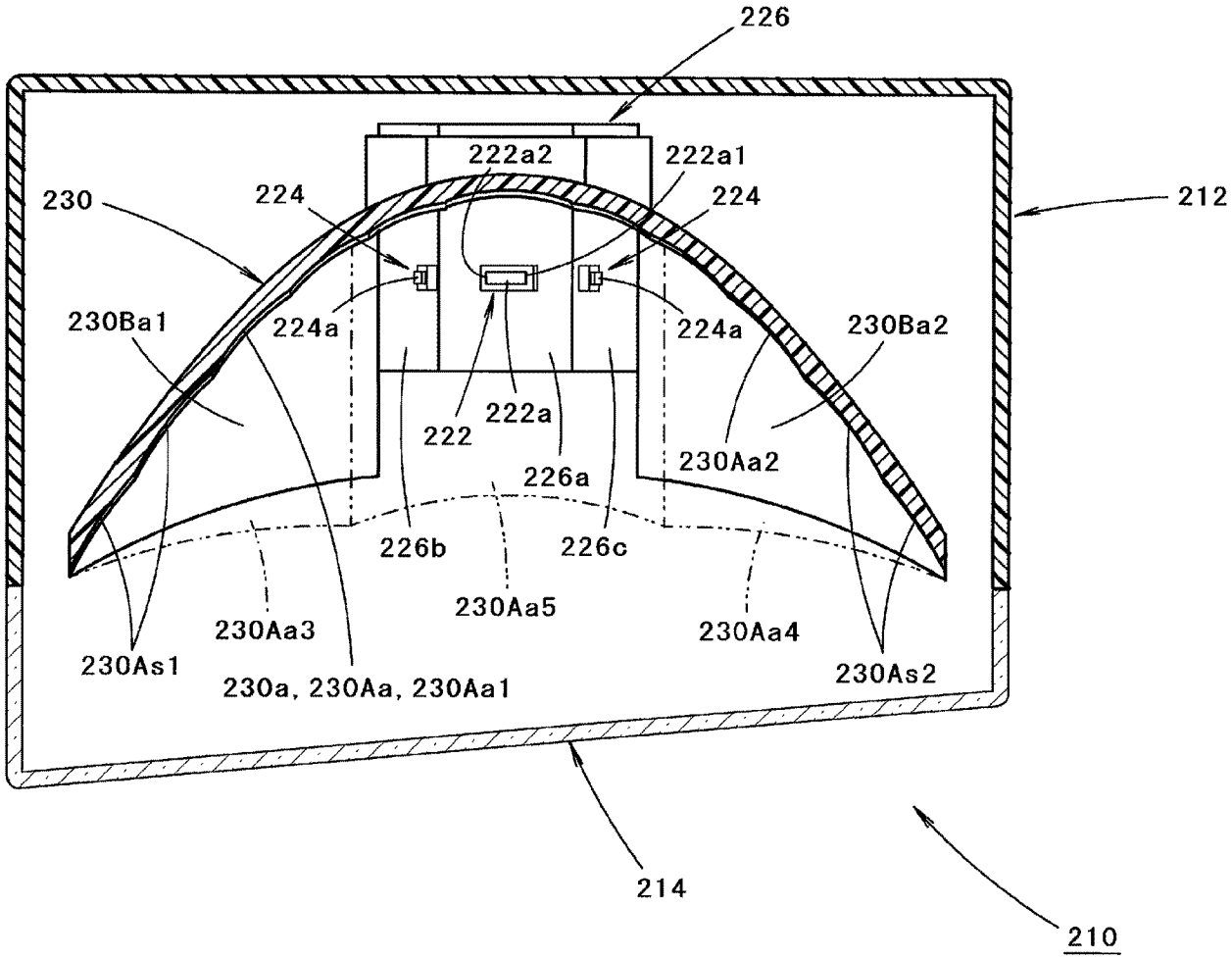
FIG.7
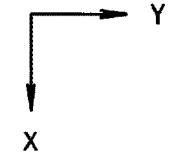

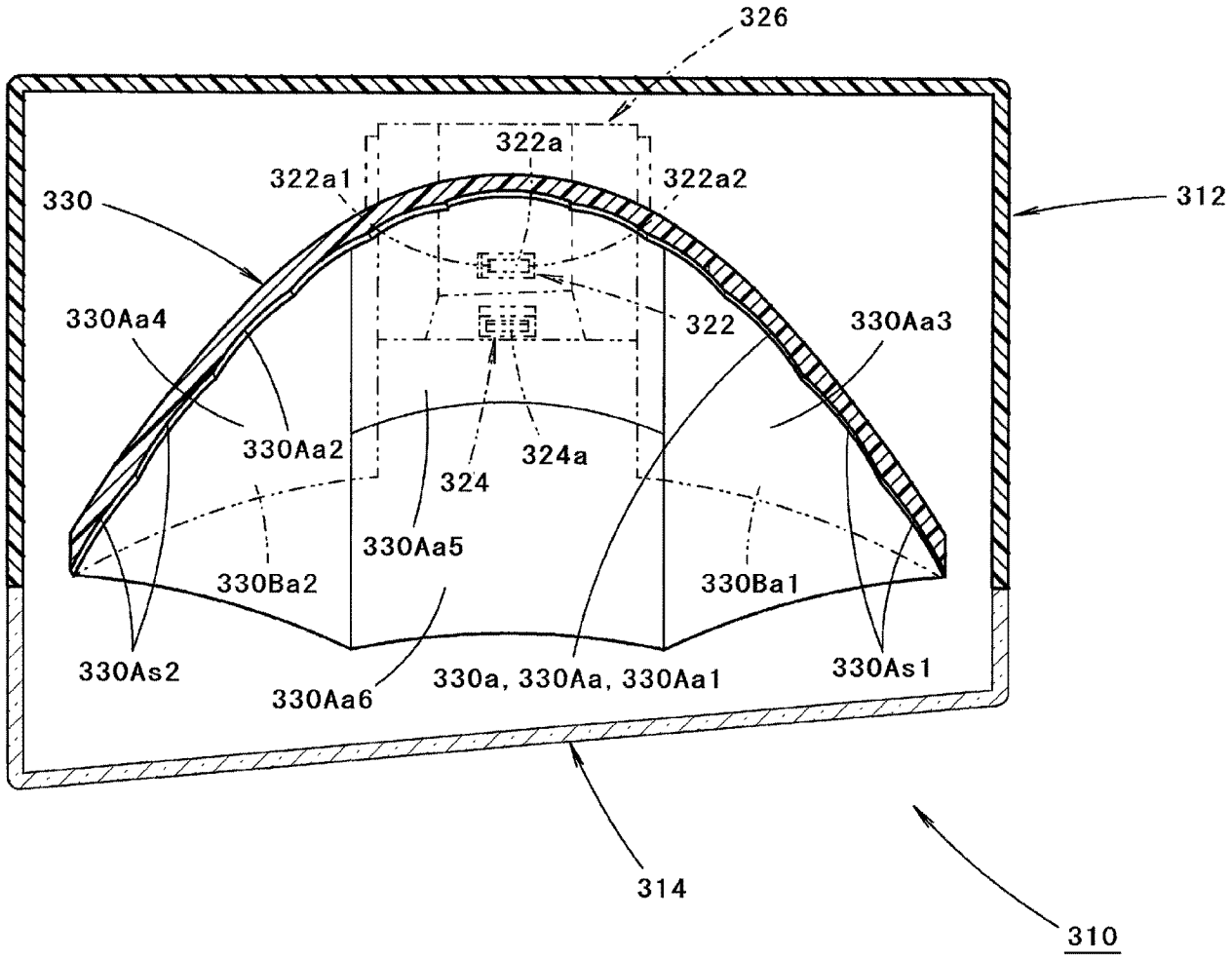
FIG.12
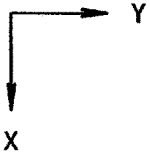

VEHICLE LAMP

TECHNICAL FIELD

The present invention relates to a vehicle lamp configured to be able to selectively perform low-beam irradiation and high-beam irradiation. The present invention also relates to a vehicle lamp configured to form a low-beam light distribution pattern having horizontal and oblique cutoff lines.

BACKGROUND ART

As a configuration of a vehicle lamp, there is known a vehicle lamp which is configured to be able to selectively perform low-beam irradiation and high-beam irradiation by reflecting light from a light-emitting element toward the front by a reflector.

Patent Document 1 discloses such a vehicle lamp which is configured to form a low-beam light distribution pattern having horizontal and oblique cutoff lines by low-beam irradiation.

Further, as a vehicle lamp that forms a low-beam light distribution pattern having horizontal and oblique cutoff lines, there is known a vehicle lamp which is configured to reflect light emitted from a light-emitting element toward the front by a reflector, as disclosed in Patent Document 2, for example.

The vehicle lamp disclosed in the Patent Document 2 includes two sets of a light-emitting element and a reflector, and is configured to form a horizontal cutoff line by one of them and to form an oblique cutoff line by the other of them.

CITATION LIST

Patent Document

Patent Document 1: Japanese Patent Publication No. 4335621

Patent Document 2: Japanese Patent Laid-Open Publication No. 2004-303639

DISCLOSURE OF INVENTION

Problems to be Solved by Invention

In the vehicle lamp disclosed in the Patent Document 1, horizontal and oblique cutoff lines are formed by turning on separate light-emitting elements. Thus, there is a problem that the cost of the lamp is increased by that much.

Further, in the vehicle lamp disclosed in the Patent Document 2, horizontal and oblique cutoff lines are formed by using light emitted from a light-emitting surface of each light-emitting element in a direction close to the normal direction thereof. Thus, there are the following problems.

That is, since the light distribution pattern formed by light emitted from the light-emitting surface in the direction close to the normal direction thereof is formed as a relatively large light distribution pattern, the light distribution pattern having the horizontal cutoff line and the light distribution pattern having the oblique cutoff line are formed as light distribution patterns with a relatively large vertical width. For this reason, there is a problem that the front-side region in the low-beam light distribution pattern becomes excessively bright, and thus, the forward visibility is decreased by that much.

The present invention aims to provide a vehicle lamp which is configured to be able to selectively perform low-beam irradiation and high-beam irradiation by reflecting light from a light-emitting element toward the front by a reflector, and thus, is capable of forming a required light distribution pattern at low cost.

Further, the present invention aims to provide a vehicle lamp which is configured to form a low-beam light distribution pattern having horizontal and oblique cutoff lines by reflecting light emitted from a light-emitting element toward the front by a reflector, and thus, is capable of improving the forward visibility.

Means for Solving the Problems

<First Aspect of Present Invention>

A first aspect of the present invention is intended to form a low-beam light distribution pattern with a configuration using a single light-emitting element by devising the configuration of a light-emitting element and a reflector, thereby achieving the above object.

A vehicle lamp according to the first aspect of the present invention is configured to be able to selectively perform low-beam irradiation and high-beam irradiation, the vehicle lamp includes:

first and second light-emitting elements; and a reflector for reflecting light emitted from these first and second light-emitting elements toward the front, in which a reflecting surface of the reflector has a first reflection region on which light emitted from the first light-emitting element is incident and a second reflection region on which light emitted from the first light-emitting element is not incident but light emitted from the second light-emitting element is incident, and in which a low-beam light distribution pattern having horizontal and oblique cutoff lines is formed by turning on the first light-emitting element, and a high-beam light distribution pattern is formed by turning on the second light-emitting element or simultaneously turning on the first and second light-emitting elements.

The type of the "first and second light-emitting elements" is not particularly limited and, for example, a light-emitting diode or a laser diode or the like can be adopted.

A specific positional relationship between the "first reflection region" and the "second reflection region" is not particularly limited.

Although the "first reflection region" is configured to form a low-beam light distribution pattern having horizontal and oblique cutoff lines by reflecting light emitted from the first light-emitting element, a specific shape of the reflecting surface for that purpose is not particularly limited.

As represented in the above configuration, the vehicle lamp according to the first aspect of the present invention is configured to form the low-beam light distribution pattern having the horizontal and oblique cutoff lines by reflecting light emitted from the first light-emitting element at the first reflection region. Therefore, the low-beam light distribution pattern can be formed by a configuration using a single light-emitting element. In this way, the cost can be reduced, as compared to a conventional vehicle lamp configured to form horizontal and oblique cutoff lines by turning on separate light-emitting elements.

Further, since the second reflection region can be used as a dedicated region for reflectively controlling the light emitted from the second light-emitting element, a deviation in luminous intensity distribution of the light distribution pattern formed by the light emitted from the second light-emitting element and reflected by the first reflection region can be corrected by superposing, on the above light distribution pattern, the light distribution pattern formed by the light emitted from the second light-emitting element and reflected by the second reflection region. In this way, it is possible to easily form a high-beam light distribution pattern with a required luminous intensity distribution.

According to the first aspect of the present invention as described above, the vehicle lamp configured to be able to selectively perform the low-beam irradiation and the high-beam irradiation by reflecting the light from the light-emitting element toward the front by the reflector can form a required light distribution pattern at low cost.

In the above configuration, the first reflection region may have a first sub-reflection region for forming the horizontal cutoff line and a second sub-reflection region for forming the oblique cutoff line, both of which are disposed at positions displaced in a right and left directions with respect to the first light-emitting element, and a light-emitting surface of the first light-emitting element may have a first side end edge located on the side opposite to the first sub-reflection region in the right and left directions and a second side end edge located on the side opposite to the second sub-reflection region in the right and left directions, both of which are formed so as to extend in a front and rear directions. In addition, the first stab-reflection region may be disposed at a position where it intersects with a horizontal plane including the first side end edge, and the second sub-reflection region may be disposed at a position where it intersects with an inclined plane including the second side end edge and inclined downward or upward at a rising angle of the oblique cutoff line with respect to the horizontal plane. With these configurations, the following operational effects can be obtained.

That is, since the first sub-reflection region is disposed at a position where it intersects with the horizontal plane including the first side end edge of the light-emitting surface of the first light-emitting element, which is located on the side opposite to the first sub-reflection region in the right and left directions, the light distribution pattern having a clear horizontal cutoff line can be formed as a light distribution pattern having a small vertical width by reflectively controlling the light emitted from the first light-emitting element at the first sub-reflection region.

At that time, a specific reason why such a clear horizontal cutoff line can be formed is as follows.

That is, when the light-emitting surface of the first light-emitting element is viewed from the first sub-reflection region, the first side end edge of the outer peripheral edge of the light-emitting surface, which is located on the side opposite to the first sub-reflection region, appears as a clear light and shade boundary line. Further, light leaking out as stray light from a peripheral region of the light-emitting surface of the first light-emitting element is mostly oriented in a direction close to the normal direction of the light-emitting surface and is hardly oriented in a direction largely inclined from the normal direction. Therefore, by forming the horizontal cutoff line by using the first sub-reflection region located in a direction largely inclined from the normal direction of the light-emitting surface, the horizontal cutoff line can be formed as a clear cutoff line.

Similarly, since the second sub-reflection region is disposed at a position where it intersects with the inclined plane including the second side end edge of the light-emitting surface of the first light-emitting element, which is located on the side opposite to the second sub-reflection region in the right and left directions, the light distribution pattern having the clear horizontal cutoff line can be formed as a light distribution pattern having a small vertical width by reflectively controlling the light emitted from the first light-emitting element at the second sub-reflection region.

Then, as described above, by forming the light distribution pattern having the clear horizontal cutoff line and the light distribution pattern having the clear oblique cutoff line as the light distribution pattern having a small vertical width, the following operational effects can be obtained.

That is, in order to secure the required brightness in each of these light distribution patterns, it is necessary to set, to a relatively small value, a diffusion angle in a direction along the horizontal cutoff line or in a direction along the oblique cutoff line. At that time, by forming each of these light distribution patterns as the light distribution pattern having a small vertical width, it is possible to previously prevent the front region of the low-beam light distribution pattern from becoming excessively bright. Thus, the forward visibility can be improved.

In this case, a specific shape of the "light-emitting surface" of the first light-emitting element is not particularly limited, so long as both the first and second side end edges thereof are formed so as to extend in the front and rear directions. At that time, the "first and second side end edges" may be identical side end edge or different side end edge.

In the above configuration, the light-emitting surface of the first light-emitting element may have an outer shape that is longer in the right and left directions than in the front and rear directions. With this configuration, the following operational effects can be obtained.

That is, since an angle in an up and down directions in which the light-emitting surface of the first light-emitting element is viewed from each of the first and second sub-reflection regions becomes large, it is possible to increase the brightness of the light distribution pattern having the horizontal cutoff line and the light distribution pattern having the oblique cutoff line. Further, the sub-reflection regions of the first reflection region other than the first and second sub-reflection regions reflect light that is emitted in a direction close to the normal direction of the light-emitting surface from the light-emitting surface of the first light-emitting element. At that time, the reflected light becomes laterally elongated light distribution patterns, and thus, it is possible to prevent the front region of the low-beam light distribution pattern from becoming excessively bright.

In the above configuration, the light-emitting surface of the second light-emitting element may have the normal direction that is oriented in a direction closer to the horizontal direction than the normal direction of the light-emitting surface of the first light-emitting element. With this configuration, it is possible to easily secure, in the reflecting surface of the reflector, a second reflection region on which light emitted from the first light-emitting element is not incident and light emitted from the second light-emitting element is incident.

At that time, the light-emitting surface of the second light-emitting element may have an outer shape that is longer in a direction orthogonal to the front and rear direction than in the front and rear directions. With this configuration, the light distribution pattern fat lied by the light, which is emitted from the second light-emitting element and reflected by the first and second reflection regions, can be easily formed as a light distribution pattern having a relatively large vertical width. In this way, it is possible to more easily foist the high-beam light distribution pattern with a required luminous intensity distribution.

<Second Aspect of Present Invention>

Further, a second aspect of the present invention is intended to achieve the above object by devising the configuration of a light-emitting element and a reflector.

That is, a vehicle lamp according to the second aspect of the present invention is configured to form a low-beam light distribution pattern having horizontal and oblique cutoff lines by reflecting light emitted from a light-emitting element toward the front by a reflector, in which a reflecting surface of the reflector has a first sub-reflection region for forming the horizontal cutoff line and a second sub-reflection region for forming the oblique cutoff line, both of which are disposed at positions displaced in a right and left directions with respect to the light-emitting element, in which a light-emitting surface of the light-emitting element has a first side end edge located on the side opposite to the first sub-reflection region in the right and left directions and a second side end edge located on the side opposite to the second sub-reflection region in the right and left directions, both of which are formed so as to extend in a front and rear directions, in which the first sub-reflection region is disposed at a position where it intersects with a horizontal plane including the first side end edge, and in which the second sub-reflection region is disposed at a position where it intersects with an inclined plane including the second side end edge and inclined downward or upward at a rising angle of the oblique cutoff line with respect to the horizontal plane.

The type of the "light-emitting element" is not particularly limited and, for example, a light-emitting diode or a laser diode or the like can be adopted.

A specific shape of the "light-emitting surface" of the light-emitting element is not particularly limited, so long as both the first and second side end edges thereof are formed so as to extend in the front and rear directions. At that time, the "first and second side end edges" may be identical side end edge or different side end edge.

A specific arrangement or shape of the "first sub-reflection region" is not particularly limited, so long as it is disposed at a position where it intersects with a horizontal plane including the first side end edge.

A specific arrangement or shape of the "second sub-reflection region" is not particularly limited, so long as it is disposed at a position where it intersects with the inclined plane including the second side end edge and inclined downward or upward at the rising angle of the oblique cutoff line with respect to the horizontal plane.

As represented in the above configuration, in the vehicle lamp according to the second aspect of the present invention, both the first sub-reflection region for forming the horizontal cutoff line and the second sub-reflection region for forming the oblique cutoff line are disposed at the positions displaced in the right and left directions with respect to the light-emitting element, and the light-emitting surface of the light-emitting element has the first side end edge located on the side opposite to the first sub-reflection region in the right and left directions and the second side end edge located on the side opposite to the second sub-reflection region in the right and left directions, both of which are formed so as to extend in the front and rear directions. Furthermore, the first sub-reflection region is disposed at the position where it intersects with the horizontal plane including the first side end edge, and the second sub-reflection region is disposed at the position where it intersects with the inclined plane including the second side end edge and inclined downward or upward at the rising angle of the oblique cutoff line with respect to the horizontal plane. Therefore, the following operational effects can be obtained.

That is, since the first sub-reflection region is disposed at the position where it intersects with the horizontal plane including the first side end edge of the light-emitting surface of the light-emitting element, which is located on the side opposite to the first sub-reflection region in the right and left directions, the light distribution pattern having the clear horizontal cutoff line can be formed as a light distribution pattern having a small vertical width by reflectively controlling the light emitted from the first light-emitting element at the first sub-reflection region.

At that time, a specific reason why such a clear horizontal cutoff line can be formed is as follows.

That is, when the light-emitting surface of the light-emitting element is viewed from the first sub-reflection region, the first side end edge of the outer peripheral edge of the light-emitting surface, which is located on the side opposite to the first sub-reflection region, appears as a clear light and shade boundary line. Further, light leaking out as stray light from a peripheral region of the light-emitting surface of the light-emitting element is mostly oriented in a direction close to the normal direction of the light-emitting surface and is hardly oriented in a direction largely inclined from the normal direction. Therefore, by forming the horizontal cutoff line by using the first sub-reflection region located in a direction largely inclined from the normal direction of the light-emitting surface, the horizontal cutoff line can be formed as a clear cutoff line.

Similarly, since the second sub-reflection region is disposed at the position where it intersects with the inclined plane including the second side end edge of the light-emitting surface of the light-emitting element, which is located on the side opposite to the second sub-reflection region in the right and left directions, the light distribution pattern having the clear horizontal cutoff line can be formed as a light distribution pattern having a small vertical width by reflectively controlling the light emitted from the light-emitting element at the second sub-reflection region.

Then, as described above, by forming the light distribution pattern having the clear horizontal cutoff line and the light distribution pattern having the clear oblique cutoff line as the light distribution pattern having a small vertical width, the following operational effects can be obtained.

That is, in order to secure the required brightness in each of these light distribution patterns, it is necessary to set, to a relatively small value, a diffusion angle in a direction along the horizontal cutoff line or in a direction along the oblique cutoff line. At that time, by forming each of these light distribution patterns as the light distribution pattern having a small vertical width, it is possible to previously prevent the front region of the low-beam light distribution pattern from becoming excessively bright. Thus, the forward visibility can be improved.

According to the present invention as described above, in the vehicle lamp configured to form the low-beam light distribution pattern having the horizontal and oblique cutoff lines by reflecting light emitted from the light-emitting element toward the front by the reflector, the forward visibility can be improved.

In addition, according to the present invention, such an operational effect can be realized by a configuration using a single light-emitting element.

In the above configuration, the specific arrangement of the first and second sub-reflection regions is not particularly limited, as described above. However, when the first and second sub-reflection regions are disposed on the same side in the right and left directions with respect to the light-emitting element, the first and second sub-reflection regions can be disposed so as to extend to a position as far as possible away from the light-emitting element in the limited space of the reflecting surface. Further, a light distribution pattern having a smaller vertical width can be formed by the reflected light from the position of these first and second sub-reflection regions distant from the light-emitting element.

As a specific configuration at that time, it is possible to adopt a configuration in which the light-emitting surface is inclined at an angle larger than the rising angle of the oblique cutoff line on the side of the first and second sub-reflection regions with respect to a vertically upward direction, and the second sub-reflection region is disposed at a position where it intersects with the inclined plane inclined downward. Alternatively, it is also possible to adopt a configuration in which the light-emitting surface is inclined at an angle smaller than the rising angle of the oblique cutoff line on the side of the first and second sub-reflection regions with respect to a vertically upward direction, and the second sub-reflection region is disposed at a position where it intersects with the inclined plane inclined upward.

In the case of adopting such a configuration, it is more preferable that the first and second sub-reflection regions are disposed adjacent to each other in the up and down directions, from the viewpoint of securing each of the formation regions as a region that is as elongated as possible.

On the other hand, in the above configuration, the first and second sub-reflection regions may be disposed on opposite sides in the right and left directions with respect to the light-emitting element. With this configuration, it is possible to easily form the shape of the reflector into a shape close to a bilaterally symmetrical shape.

As a specific configuration at that time, it is possible to adopt a configuration in which the light-emitting element is disposed in a state where its light-emitting surface faces upward and the second sub-reflection region is disposed at a position where it intersects with the inclined plane inclined upward. Alternatively, it is also possible to adopt a configuration in which the light-emitting element is disposed in a state where its light-emitting surface faces downward and the second sub-reflection region is disposed at a position where it intersects with the inclined plane inclined downward.

In the above configuration, the light-emitting surface of the light-emitting element may have an outer shape that is longer in the right and left directions than in the front and rear directions. With this configuration, the following operational effects can be obtained.

That is, since an angle in the up and down direction in which the light-emitting surface of the light-emitting element is viewed from each of the first and second sub-reflection regions becomes large, it is possible to increase the brightness of the light distribution pattern having the horizontal cutoff line and the light distribution pattern having the oblique cutoff line. Further, the reflection regions of the reflecting surface other than the first and second sub-reflection regions reflect light that is emitted in a direction close to the normal direction of the light-emitting surface from the light-emitting surface of the light-emitting element. At that time, the reflected light becomes laterally elongated light distribution patterns, and thus, it is possible to prevent the front region of the low-beam light distribution pattern from becoming excessively bright.

BRIEF DESCRIPTION OF DRAWINGS

FIG. 4A shows a low-beam light distribution pattern and FIG. 4B shows a high-beam light distribution pattern.

FIG. 7 is a sectional view taken along the line VII-VII shown in FIG. 6.

FIG. 12 is a sectional view taken along the line XII-XII shown in FIG. 11.

EMBODIMENT FOR CARRYING OUT INVENTION

Hereinafter, embodiments of the present invention will be described with reference to the drawings.

First, a first embodiment of the present invention will be described.

Figure 1:
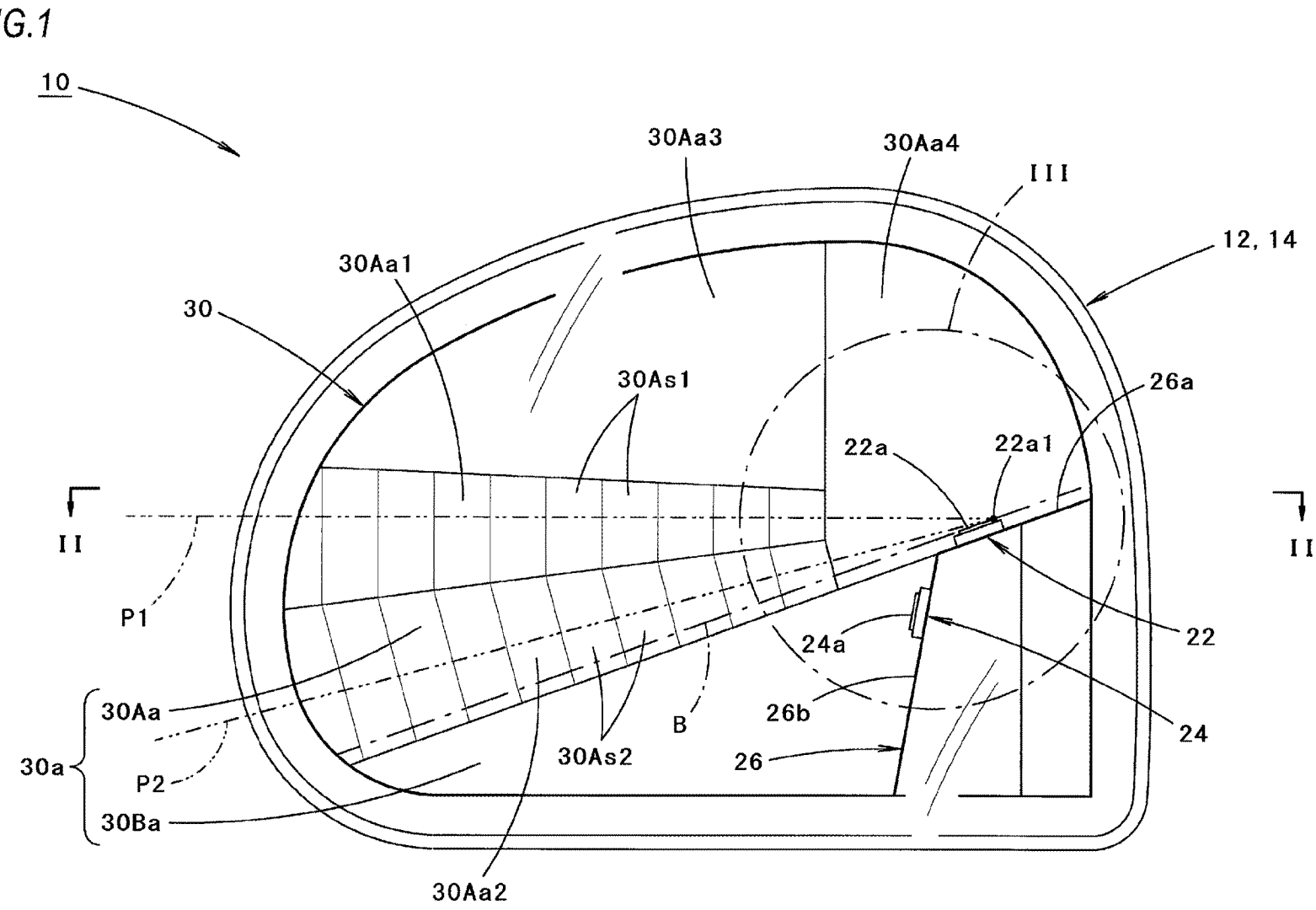
FIG. 1 is a front view showing a vehicle lamp according to a first embodiment of the present invention.

FIG. 1 is a front view showing a vehicle lamp 10 according to the present embodiment. Further, FIG. 2 is a sectional view taken along the line II-II shown FIG. 1 and FIG. 3 is a detailed view of the III part shown in FIG. 1.

As shown in these figures, the vehicle lamp 10 according to the present embodiment is a headlamp disposed at the left front end portion of a vehicle and is configured to be able to selectively perform low-beam irradiation and high-beam irradiation.

Figure 2:
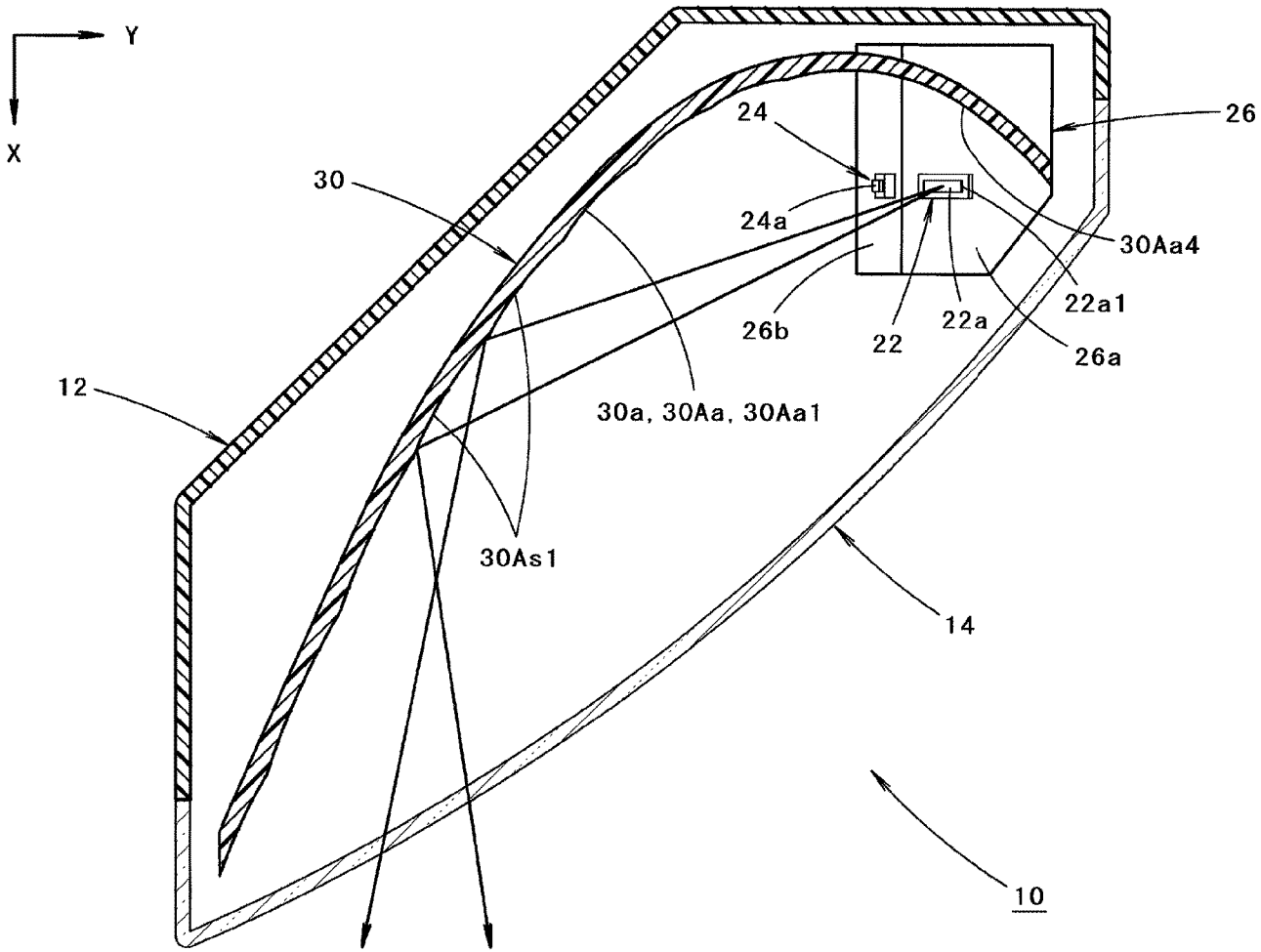
FIG. 2 is a sectional view taken along the line II-II shown FIG. 1.
Figure 3:
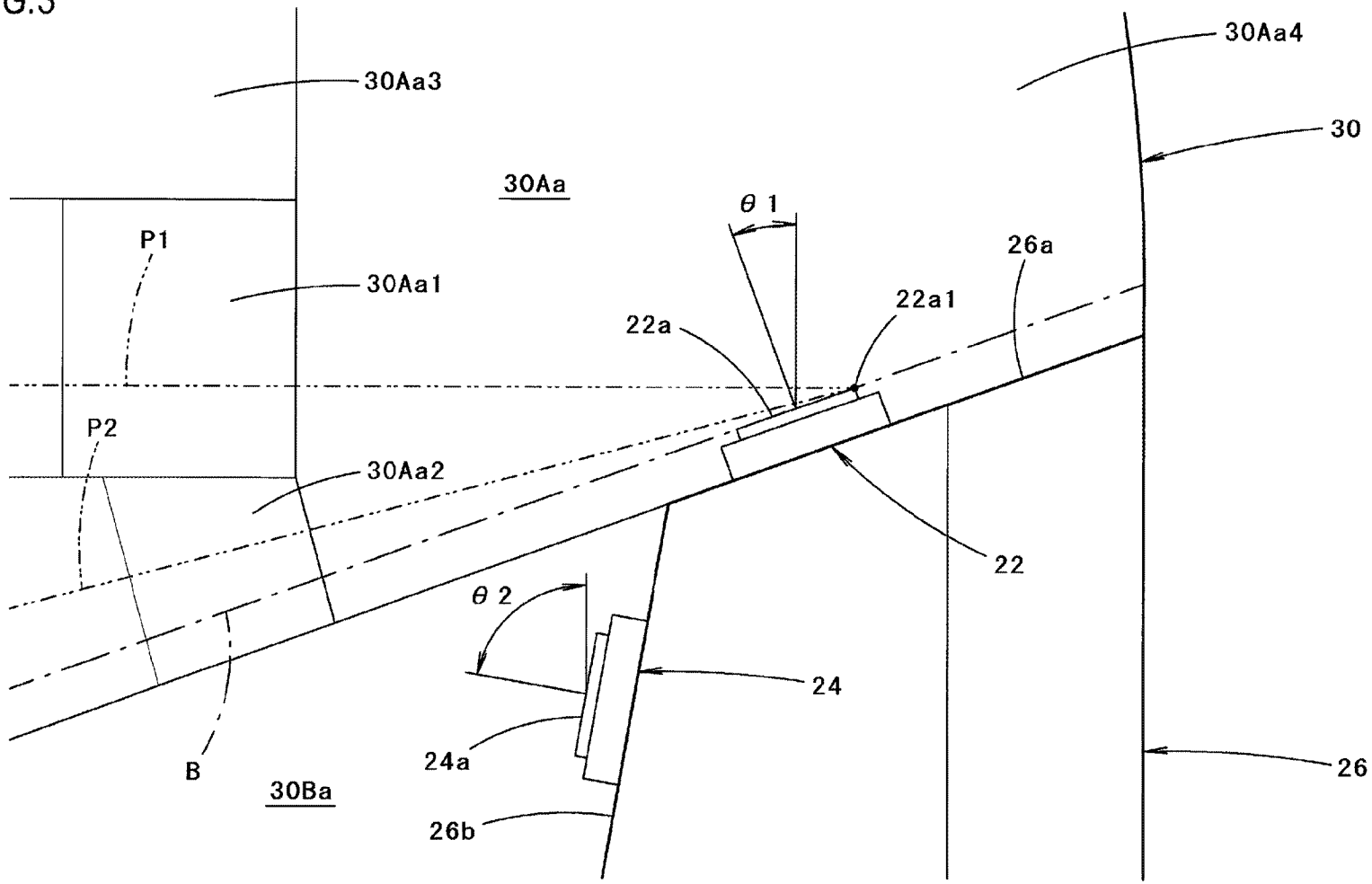
FIG. 3 is a detailed view of the III part shown in FIG. 1.

Meanwhile, for the vehicle lamp 10, in FIG. 2, a direction indicated by "X" is a "front direction" ("front direction" also for the vehicle), and a direction indicated by "Y" is a "left direction" ("left direction" also for the vehicle but a "right direction" as seen in a front view of the lamp) perpendicular to the "front direction."

The vehicle lamp 10 has a configuration in which first and second light-emitting elements 22, 24 and a reflector 30 for reflecting light emitted from these first and second light-emitting elements 22, 24 toward the front are incorporated in a lamp chamber which is defined by a lamp body 12 and a plain translucent cover 14 attached to a front end opening thereof.

Then, the vehicle lamp 10 has a configuration in which a low-beam light distribution pattern having horizontal and oblique cutoff lines is formed by turning on the first light-emitting element 22 and a high-beam light distribution pattern is formed by turning on the second light-emitting element 24.

As shown in FIG. 2, the translucent cover 14 is formed so as to go around rearward from the inner side (i.e., right side) in a vehicle width direction toward the outer side in the vehicle width direction.

Both the first and second light-emitting elements 22 and 24 are white light-emitting diodes and have elongated rectangular light-emitting surfaces 22*a* and 24*a*. Each of the light-emitting surfaces 22*a* and 24*a* is configured so that its longer side is set to a value twice or more times (e.g., about 4 times) its short side.

These first and second light-emitting elements 22 and 24 are disposed at the left rear end portion in the lamp chamber and are supported on a common heat sink 26.

The first light-emitting element 22 is disposed on an upper surface 26*a* of the heat sink 26 in a state where its light-emitting surface 22*a* is inclined to the right side ("left side" in the front view of the lamp) with respect to the vertically upward direction. At that time, an inclination angle θ1 of the normal direction of the light-emitting surface 22*a* to the vertically upward direction is set to a value (e.g., a value of about 20°) of $15° \leq \theta 1 \leq 30°$. In addition, the first light-emitting element 22 is disposed in a state where its light-emitting surface 22*a* is elongated in a right and left direction. Therefore, a side end edge 22*a*1 constituting the short side on the outer side in the vehicle width direction of the light-emitting surface 22*a* is configured by a horizontal line extending in a front and rear direction.

The second light-emitting element 24 is disposed at a position on the obliquely right lower side of the first light-emitting element 22 and on a right surface 26*b* of the heat sink 26 in a state where the normal direction of the light-emitting surface 24*a* thereof is oriented in a direction closer to the horizontal direction than the normal direction of the light-emitting surface 22*a* of the first light-emitting element 22. At that time, an inclination angle θ2 of the light-emitting surface 24*a* to the vertically upward direction is set to a value (e.g., a value of about 80°) of $45° \leq \theta 2 \leq 90°$. Further, the second light-emitting element 24 is disposed in a state where the light-emitting surface 24*a* is elongated in a direction orthogonal to the front and rear direction.

The reflector 30 is formed so as to extend from the rear of the first and second light-emitting elements 22 and 24 toward the right front end portion in the lamp chamber.

A reflecting surface 30*a* of the reflector 30 has a first reflection region 30Aa on which light emitted from the first light-emitting element 22 is incident and a second reflection region 30Ba on which the light emitted from the first light-emitting element 22 is not incident but light emitted from the second light-emitting element 24 is incident. At this time, a boundary line B between the first reflection region 30Aa and the second reflection region 30Ba is set to a position where an extension plane of the light-emitting surface 22*a* of the first light-emitting element 22 intersects with the reflecting surface 30*a*, as indicated by a chain line in FIGS. 1 and 3.

The first reflection region 30Aa has a first sub-reflection region 30Aa1 for forming the horizontal cutoff line and a second sub-reflection region 30Aa2 for forming the oblique cutoff line.

The first and second sub-reflection regions 30Aa1 and 30Aa2 are disposed at positions on an inner side in the vehicle width direction (i.e., the right side) with respect to the first and second light-emitting elements 22 and 24. At that time, the first and second sub-reflection regions 30Aa1 and 30Aa2 are adjacent to each other in the up and down direction in the state where the first sub-reflection region 30Aa1 is disposed higher than the second sub-reflection region 30Aa2. Then, the first and second sub-reflection regions 30Aa1, 30Aa2 are formed over a wide range from a position somewhat distant inward in the vehicle width direction with respect to the first light-emitting element 22 to an end edge position on the inner side in the vehicle width direction of the reflecting surface 30*a*.

The first sub-reflection region 30Aa1 is disposed at a position where it intersects with a horizontal plane P1 (indicated by a two-dot chain line in FIGS. 1 and 3) including the side end edge 22*a*1 of the light-emitting surface 22*a* of the first light-emitting element 22. At that time, the first sub-reflection region 30Aa1 is formed such that its upper end edge extends slightly upward with respect to the horizontal direction and toward the inner side in the vehicle width direction above the side end edge 22*a*1 and its lower end edge extends slightly downward with respect to the horizontal direction and toward the inner side in the vehicle width direction below the side end edge 22*a*1.

The first sub-reflection region 30Aa1 is composed of a plurality of reflective elements 30As1 partitioned into vertical stripes. Then, each of these reflective elements 30As1 is adapted to reflect the light emitted from the first light-emitting element 22 toward the front as light that is slightly deflected downward and diffused and/or deflected in the horizontal direction.

The second sub-reflection region 30Aa2 is disposed at a position where it intersects with an inclined plane P2 (indicated by a two-dot chain line in FIGS. 1 and 3) including the side end edge 22*a*1 of the light-emitting surface 22*a* of the first light-emitting element 22 and inclined downward by 15° with respect to the horizontal plane. At that time, the second sub-reflection region 30Aa2 is set to a position (i.e., a position slightly below the boundary line B) where its upper end edge coincides with the lower end edge of the first sub-reflection region 30Aa1 and its lower end edge intersects with the extension plane of the upper surface 26*a* of the heat sink M.

The second sub-reflection region 30Aa2 is composed of a plurality of reflective elements 30As2 partitioned into oblique vertical stripes in a direction orthogonal to the inclined plane P2. Then, each of these reflective elements 30As2 is adapted to reflect the light emitted from the first light-emitting element 22 toward the front as light that is slightly deflected downward and diffused and/or deflected in a direction along the inclined plane P2.

The first reflection region 30Aa has a third sub-reflection region 30Aa3 adjacent above the first sub-reflection region 30Aa1 and a fourth sub-reflection region 30Aa4, in addition to the first and second sub-reflection regions 30Aa1, 30Aa2 adjacent to the left side of these regions. At that time, a lower end edge of the fourth sub-reflection region 30Aa4 is set to a position where it intersects with the extension plane of the upper surface 26*a* of the heat sink 26.

The third sub-reflection region 30Aa3 is adapted to reflect the light emitted from the first light-emitting element 22 toward the front as light that is slightly deflected downward and is relatively largely diffused in the right and left direction. Further, the fourth sub-reflection region 30Aa4 is adapted to reflect the light emitted from the first light-emitting element 22 toward the front as light that is slightly deflected downward and is largely diffused in the right and left directions.

On the other hand, most of the second reflection region 30Ba is disposed at a position adjacent to the lower side of the second and fourth sub-reflection regions 30Aa2, 30Aa4 on the right side of the right surface 26*b* of the heat sink 26.

The second reflection region 30Ba is adapted to reflect the light emitted from the second light-emitting element 24 toward the front as light that is slightly diffused in the right and left directions.

Figure 4A:
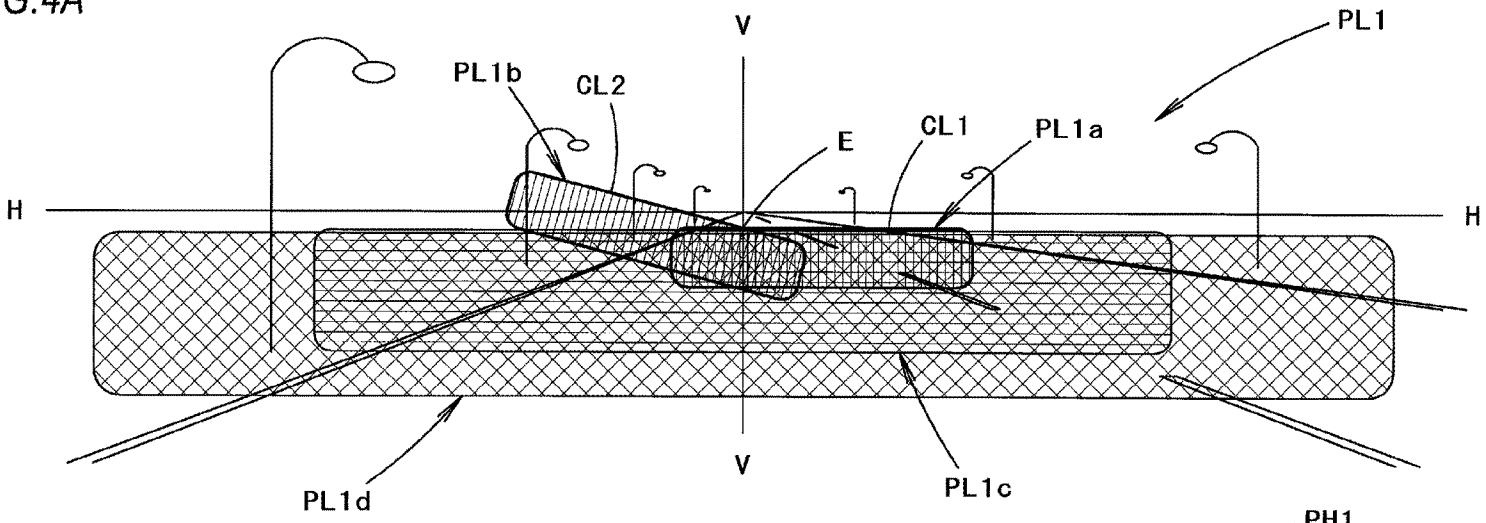
FIGS. 4A and 4B are views transparently showing a light distribution pattern formed by irradiation light from the vehicle lamp.
Figure 4B:
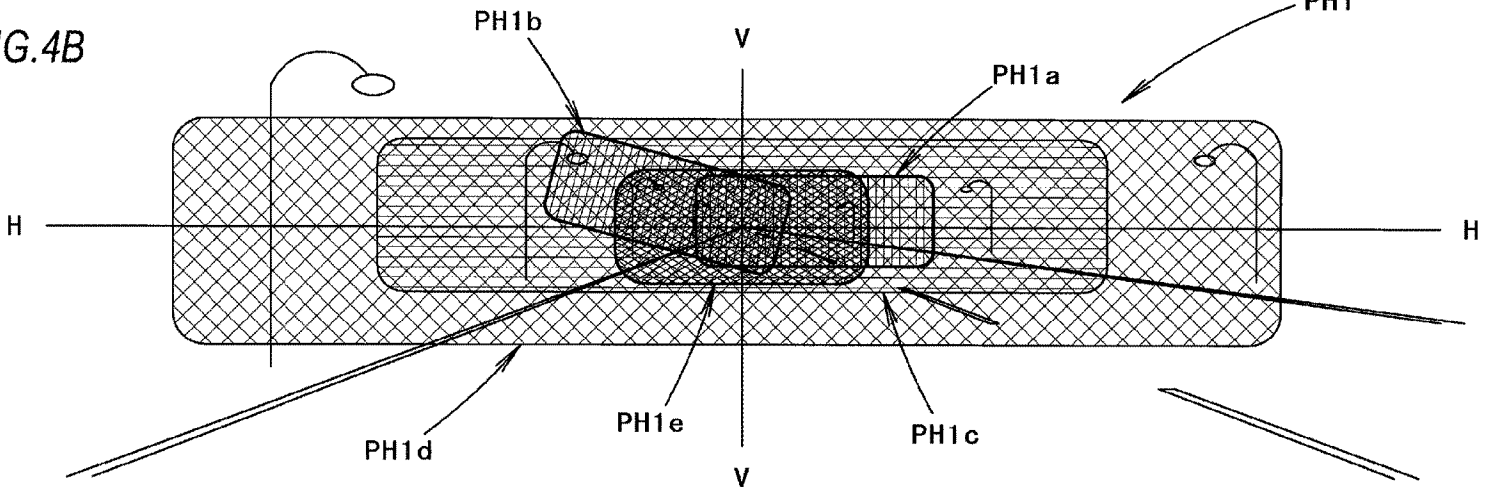

FIGS. 4A and 4B are views transparently showing a light distribution pattern which is formed on a virtual vertical screen disposed at a position of 25 m in front of the lamp by light irradiated forward from the vehicle lamp 10. At that time, the light distribution pattern shown in FIG. 4A is a low-beam light distribution pattern and the light distribution pattern shown in FIG. 4B is a high-beam light distribution pattern.

A low-beam light distribution pattern PL1 shown in FIG. 4A is a low-beam light distribution pattern of left light distribution and has cutoff lines CL1, CL2 at an upper end edge thereof. In the cutoff lines CL1, CL2, an oncoming vehicle-lane side portion on the right side of a V-V line vertically passing through a point H-V that is a vanishing point in a lamp front direction is formed as the horizontal cutoff line CL1 and an own vehicle-lane side portion on the left side of the V-V line is formed as the oblique cutoff line CL2.

In the low-beam light distribution pattern PL1, an elbow point E that is an intersection between the horizontal cutoff line CL1 and the oblique cutoff line CL2 is positioned at an angle of about 0.5° to 0.6° below the point H-V.

The low-beam light distribution pattern PL1 is formed as a combined light distribution pattern of four light distribution patterns PL1*a*, PL1*b*, PL1*c*, PL1*d* that are formed by turning on the first light-emitting element 22.

The light distribution pattern PL1*a* is a light distribution pattern that is formed by light reflected from the first sub-reflection region 30Aa1.

The light distribution pattern PL1*a* is formed as a bright light distribution pattern that is a laterally elongated light distribution pattern extending horizontally from the slightly left position of the line V-V toward the right side of the line V-V and has a narrow vertical width. The clear horizontal cutoff line CL1 is formed at an upper end edge of the light distribution pattern PL1*a*.

The reason why the light distribution pattern PL1*a* is formed as the light distribution pattern including the clear horizontal cutoff line CL1 at its upper end edge and having the narrow vertical width is that the first sub-reflection region 30Aa1 is disposed at a position where it intersects with the horizontal plane P1 including the side end edge 22*a*1 (i.e., first side end edge located on the side opposite to the first sub-reflection region 30Aa1 in the right and left directions) of the light-emitting surface 22*a* obliquely upward. Further, the reason why the light distribution pattern PL1*a* is formed as a bright light distribution pattern is that the light-emitting surface 22*a* of the first light-emitting element 22 has an outer shape that is longer in the right and left directions than in the front and rear directions, and thus, an angle in the up and down directions when the light-emitting surface 22*a* is viewed from the first sub-reflection region 30Aa1 is increased.

The light distribution pattern PL1*b* is a light distribution pattern formed by the light reflected from the second sub-reflection region 30Aa2.

The light distribution pattern PL1*b* is formed as a bright light distribution pattern that is a laterally elongated light distribution pattern extending obliquely upward at an inclination angle of 15° from the slightly right position of the line V-V toward the left side of the line V-V and has a narrow vertical width. The clear horizontal cutoff line CL2 is formed at an upper end edge of the light distribution pattern PL1*a*.

The reason why the light distribution pattern PL1*b* is formed as the light distribution pattern including the clear oblique cutoff line CL2 at its upper end edge and having the narrow vertical width is that the second sub-reflection region 30Aa2 is disposed at a position where it intersects with the inclined plane P2 including the side end edge 22*a*1 (i.e., second side end edge located on the side opposite to the second sub-reflection region 30Aa2 in the right and left directions) of the light-emitting surface 22*a* obliquely upward. Further, the reason why the light distribution pattern PL1*b* is formed as a bright light distribution pattern is that the light-emitting surface 22*a* of the first light-emitting element 22 has an outer shape that is longer in the right and left directions than in the front and rear directions, and thus, an angle in the up and down directions when the light-emitting surface 22*a* is viewed from the second sub-reflection region 30Aa2 is increased.

The light distribution pattern PL1*c* is formed as a laterally elongated light distribution pattern that is a light distribution pattern formed by the light reflected from the third sub-reflection region 30Aa3 and is relatively largely diffused to the left and right sides around the V-V line below the horizontal cutoff line CL1.

The light distribution pattern PL1*d* is formed as a laterally elongated light distribution pattern that is a light distribution pattern formed by the light reflected from the fourth sub-reflection region 30Aa4 and is relatively largely diffused to the left and right sides around the V-V line below the horizontal cutoff line CL1.

The high-beam light distribution pattern PH1 shown in FIG. 4B is formed as a laterally elongated light distribution pattern spreading to the left and sides around the H-V.

The high-beam light distribution pattern PH1 is formed as a combined light distribution pattern of five light distribution patterns PH1*a*, PH1*b*, PH1*c*, PH1*d*, PH1*e* formed by turning on the second light-emitting element 24.

Four light distribution patterns PH1*a* to PH1*d* are light distribution patterns formed by the light reflected from the first to fourth sub-reflection region 30Aa1 to 30Aa4.

Each of these light distribution patterns PH1 to PH1*d* is formed as a light distribution pattern that is obtained by displacing, slightly upward, each of the light distribution patterns PL1*a* to PL1*d* formed by turning on the first light-emitting element 22, making a vertical width thereof slightly wider, and reducing a diffusion angle thereof in the right and left directions.

At that time, the reason why each of the light distribution patterns PH1*a* to PH1*d* is displaced slightly upward is that the second light-emitting element 24 is located below the first light-emitting element 22. Further, the reason why the vertical width of each of the light distribution patterns PH1*a* to PH1*d* is slightly wide and the diffusion angle in the right and left directions thereof is reduced is that the normal direction of the light-emitting surface 24*a* of the second light-emitting element 24 is oriented in a direction closer to the horizontal direction than the normal direction of the light-emitting surface 22*a* of the first light-emitting element 22.

The remaining one light distribution pattern PH1*e* is a light distribution pattern that is formed by the light reflected from the second reflection region 30Ba.

The light distribution pattern PH1*e* is formed as a slightly laterally elongated light distribution pattern centered on the H-V. At that time, the light distribution pattern PH1*e* is formed as a spot-like bright light distribution pattern.

The light distribution pattern PH1*e* is superposed on the position of the H-V with respect to the four light distribution patterns PH1*a* to PH1*d*, so that a deviation in the luminous intensity distribution of the four light distribution patterns PH1*a* to PH1*d* is corrected. In this way, the high-beam light distribution pattern PH1 is formed as a light distribution pattern that has a suitable luminous intensity distribution where the luminous intensity is the highest in the vicinity of the H-V and is gradually decreased toward the peripheral region thereof.

Next, operational effects of the present embodiment will be described.

Since the vehicle lamp 10 according to the present embodiment is configured to form the low-beam light distribution pattern PL1 having the horizontal and oblique cutoff lines CL1, CL2 by reflecting light emitted from the first light-emitting element 22 at the first reflection region 30Aa, it is possible form the low-beam light distribution pattern PL1 by a configuration using a single light-emitting element. In this way, the cost can be reduced, as compared to a conventional vehicle lamp configured to form the horizontal and oblique cutoff lines CL1, CL2 by turning on separate light-emitting elements.

Further, since the second reflection region 30Ba can be used as a dedicated region for reflectively controlling the light emitted from the second light-emitting element 24, a deviation in luminous intensity distribution of the light distribution patterns PH1*a*, PH1*b*, PH1*c*, PH1*d* formed by the light emitted from the second light-emitting element 24 and reflected by the first reflection region 30Aa can be corrected by superposing, on the light distribution patterns PH1*a*, PH1*b*, PH1*c*, PH1*d*, the light distribution pattern PH1*e* formed by the light emitted from the second light-emitting element 24 and reflected by the second reflection region 30Ba. In this way, it is possible to easily form the high-beam light distribution pattern PH1 with a required luminous intensity distribution.

According to the present embodiment as described above, the vehicle lamp 10 configured to be able to selectively perform the low-beam irradiation and the high-beam irradiation by reflecting the light from the light-emitting element toward the front by the reflector can form a required light distribution pattern at low cost.

Furthermore, in the vehicle lamp 10 according to the present embodiment, the first reflection region 30Aa has the first sub-reflection region 30Aa1 for forming the horizontal cutoff line CL1 and the second sub-reflection region 30Aa2 for forming the oblique cutoff line CL2, both of which are disposed at positions displaced to the inner side (i.e., to the right side) in the vehicle width direction with respect to the first light-emitting element 22, and the side end edge 22*a*1 of the light-emitting surface 22*a* of the first light-emitting element 22 is formed so as to extend in the front and rear directions. In addition, the first and second sub-reflection regions 30Aa1, 30Aa2 are respectively disposed at positions where they intersect with the horizontal plane P1 including the side end edge 22*a*1 and the downward inclined plane P2. Therefore, the following operational effects can be obtained.

That is, since the first sub-reflection region 30Aa1 is disposed at a position where it intersects with the horizontal plane P1 including the side end edge 22*a*1 of the light-emitting surface 22*a* of the first light-emitting element 22, which is a first side end edge located on the side opposite to the first sub-reflection region 30Aa1 in the right and left directions, the light distribution pattern PL1*a* having the clear horizontal cutoff line CL1 can be formed as a light distribution pattern having a small vertical width by reflectively controlling the light emitted from the first light-emitting element 22 at the first sub-reflection region 30Aa1.

At that time, a specific reason why such a clear horizontal cutoff line CL1 can be formed is as follows.

That is, when the light-emitting surface 22*a* of the first light-emitting element 22 is viewed from the first sub-reflection region 30Aa1, the first side end edge 22*a*1 of the outer peripheral edge of the light-emitting surface, which is located on the side opposite to the first sub-reflection region, appears as a clear light and shade boundary line. Further, light leaking out as stray light from a peripheral region of the light-emitting surface 22*a* of the first light-emitting element 22 is mostly oriented in a direction close to the normal direction of the light-emitting surface 22*a* and is hardly oriented in a direction largely inclined from the normal direction. Therefore, by forming the horizontal cutoff line CL1 using the first sub-reflection region 30Aa1 positioned in a direction largely inclined from the normal direction of the light-emitting surface 22*a*, the horizontal cutoff line can be formed as a clear cutoff line.

Similarly, since the second sub-reflection region 30Aa2 is disposed at a position where it intersects with the inclined plane P2 including the side end edge 22*a*1 of the light-emitting surface 22*a* of the first light-emitting element 22, which is a second side end edge located on the side opposite to the second sub-reflection region 30Aa2 in the right and left directions, the light distribution pattern PL1*b* having the clear horizontal cutoff line CL2 can be formed as a light distribution pattern having a small vertical width by reflectively controlling the light emitted from the first light-emitting element 22 at the second sub-reflection region 30Aa2.

Then, as described above, by forming the light distribution pattern PL1*a* having the clear horizontal cutoff line CL1 and the light distribution pattern PL1*b* having the clear oblique cutoff line CL2 as the light distribution pattern having a small vertical width, the following operational effects can be obtained.

That is, in order to secure the required brightness in each of these light distribution patterns PL1*a*, PL1*b*, it is necessary to set, to a relatively small value, a diffusion angle in a direction along the horizontal cutoff line CL1 or in a direction along the oblique cutoff line CL2. At that time, by forming each of these light distribution patterns PL1*a*, PL1*b* as the light distribution pattern having a small vertical width, it is possible to previously prevent the front region of the lowbeam light distribution pattern PL1 from becoming excessively bright. Thus, the forward visibility can be improved.

According to the present embodiment as described above, in the vehicle lamp 10 configured to form the low-beam light distribution pattern PL1 having the horizontal and oblique cutoff lines CL1, CL2 by reflecting light emitted from the first light-emitting element 22 toward the front by the reflector 30, the forward visibility can be improved.

Moreover, according to the present embodiment, such an operational effect can be realized by a configuration using the single first light-emitting element 22.

Further, in the present embodiment, both the first and second sub-reflection regions 30Aa1, 30Aa2 are disposed on the inner side in the vehicle width direction with respect to the first light-emitting element 22. Therefore, the first and second sub-reflection regions 30Aa1, 30Aa2 can be disposed so as to extend to a position as far as possible away from the light-emitting element 22 in the limited space of the reflecting surface 30*a*. Further, each of the light distribution patterns PL1*a*, PL1*b* can be formed as a light distribution pattern having a smaller vertical width by the reflected light from the position of these first and second sub-reflection regions 30Aa1, 30Aa2 distant from the light-emitting element 22.

Further, in the present embodiment, the light-emitting surface 22*a* of the first light-emitting element 22 has an outer shape that is longer in the right and left directions than in the front and rear directions. Therefore, the following operational effects can be obtained.

That is, since an angle in the up and down directions in which the light-emitting surface 22*a* of the first light-emitting element 22 is viewed from each of the first and second sub-reflection regions 30Aa1, 30Aa2 becomes large, it is possible to increase the brightness of the light distribution pattern PL1*a* having the horizontal cutoff line CL1 and the light distribution pattern PL1*b* having the oblique cutoff line CL2. Further, the third and fourth sub-reflection regions 30Aa3, 30Aa4, which are sub-reflection regions of the first reflection region 30Aa other than the first and second sub-reflection regions 30Aa1, 30Aa2, reflect light that is emitted in a direction close to the normal direction of the light-emitting surface from the light-emitting surface 22*a* of the first light-emitting element 22. At that time, the reflected light becomes laterally elongated light distribution patterns PL1*c*, PL1*d*, and thus, it is possible to prevent the front region of the low-beam light distribution pattern PL1 from becoming excessively bright.

Further, in the present embodiment, the light-emitting surface 24*a* of the second light-emitting element 24 has the normal direction that is oriented in a direction closer to a horizontal direction than the normal direction of the light-emitting surface 22*a* of the first light-emitting element 22. Therefore, it is possible to easily secure, in the reflecting surface 30*a* of the reflector 30, the second reflection region 30Ba on which light emitted from the first light-emitting element 22 is not incident and light emitted from the second light-emitting element 24 is incident.

At that time, the light-emitting surface 24*a* of the second light-emitting element 24 has an outer shape that is longer in the direction orthogonal to the front and rear directions than in the front and rear directions. Therefore, each of the light distribution patterns PH1*a* to PH1*e* formed by the light, which is emitted from the second light-emitting element 24 and reflected by the first and second reflection regions 30Aa, 30Ba, can be formed as a light distribution pattern having a relatively lame vertical width. In this way, it is possible to more easily form the high-beam light distribution pattern PH1 with a required luminous intensity distribution.

Further, as in the present embodiment, by adopting a configuration in which the light-emitting surface 22*a* of the first light-emitting element 22 is inclined to the inner side in the vehicle width direction with respect to the vertically upward direction and at an angle larger than the rising angle of the oblique cutoff line CL2, and the second sub-reflection region 30Aa2 is disposed at a position where it intersects with the downward inclined plane P2, the vehicle lamp 10 can be suitably used as a left lamp when forming the low-beam light distribution pattern PL1 of left light distribution.

In the above embodiment, the high-beam light distribution pattern PH1 is formed by turning on the second light-emitting element 24. However, a high-beam light distribution pattern may be formed as a light distribution pattern where the high-beam light distribution pattern PH1 is superposed on the low-beam light distribution pattern PL1 by simultaneously turning on the first and second light-emitting elements 22, 24. In the case of adopting such a configuration, it is possible to make the high-beam light distribution pattern even brighter.

In the above embodiment, it has been described that the vehicle lamp 10 is configured to form the low-beam light distribution pattern PL1 of left light distribution. However, by adopting a configuration in which the vehicle lamp 10 according to the above embodiment is reversed left and right, it is possible to form a low-beam light distribution pattern of right light distribution.

Next, a modification of the above embodiment will be described.

Figure 5:
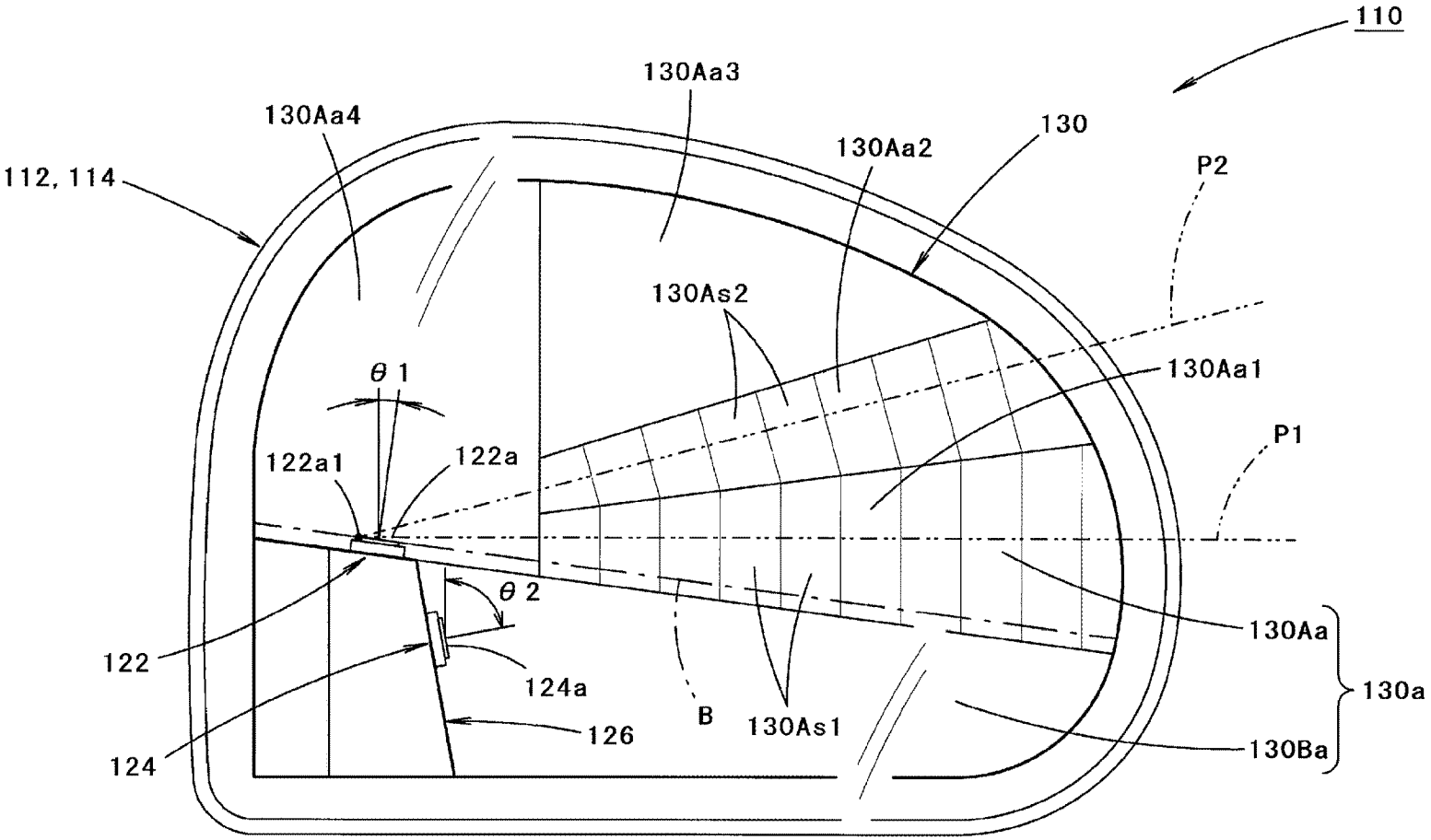
FIG. 5 is a view similar to FIG. 1, showing a modification of the first embodiment.

FIG. 5 is a view similar to FIG. 1, showing a vehicle lamp 110 according to the present modification.

As shown in FIG. 5, the vehicle lamp 110 is a headlamp disposed at the right front end portion of a vehicle and is configured to be able to selectively perform low-beam irradiation and high-beam irradiation.

A basic configuration of the vehicle lamp 110 is the same as the configuration in which the vehicle lamp 10 according to the above embodiment is reversed left and right. However, the present modification is partially different from the above embodiment in the arrangement of first and second light-emitting elements 122, 124 and the configuration of a reflector 130. Meanwhile, the configurations of the first and second light-emitting elements 122, 124 themselves are the same as those of the first and second light-emitting elements 22, 24 of the above embodiment.

In the present modification, the first and second light-emitting elements 122, 124 are supported on a common heat sink 126 in a state of being disposed at the left rear end portion in the lamp chamber.

At that time, the fast light-emitting element 122 is disposed in a position slightly lower than in the case of the above embodiment and in a state where its light-emitting surface 122*a* is inclined to the left side with respect to the vertically upward direction. At that time, the inclination angle $\theta 1$ of the normal direction of the light-emitting surface 122*a* to the vertically upward direction is set to a value (e.g., a value of about 5°) of $0° \leq \theta 1 \leq 15°$.

On the other hand, the second light-emitting element 124 is disposed at a position on the obliquely left lower side of the first light-emitting element 122 and in a state where the normal direction of its light-emitting surface 124*a* is oriented in a direction closer to the horizontal direction than the normal direction of the light-emitting surface 122*a* of the first light-emitting element 122. At that time, an inclination angle of the light-emitting surface 124*a* is set to the same value as in the above embodiment.

The reflector 130 has an outer shape that is bilaterally symmetrical with the reflector 30 of the above embodiment, as seen in the front view of the lamp.

The reflecting surface 130*a* of the reflector 130 also has a first reflection region 130Aa on which light emitted from the first light-emitting element 122 is incident and a second reflection region 130Ba on which the light emitted from the first light-emitting element 122 is not incident but light emitted from the second light-emitting element 124 is incident, with the boundary line B at which an extension plane of the light-emitting surface 122*a* of the first light-emitting element 122 intersects with the reflecting surface 130*a* as a boundary.

As in the case of the above embodiment, the first reflection region 130Aa is composed of first, second, third and fourth sub-reflection regions 130Aa1, 130Aa2, 130Aa3, 130Aa4. However, the second sub-reflection region 130Aa2 for forming the oblique cutoff line is disposed adjacent to the upper side of the first sub-reflection region 130Aa1 for forming the horizontal cutoff line.

The first sub-reflection region 130Aa1 is disposed at a position where it interests with the horizontal plane P1 including a right side end edge 122*a*1 of the light-emitting surface 122*a* of the first light-emitting element 122. At that time, the first sub-reflection region 130Aa1 has an upper end edge that extends slightly upward with respect to the horizontal direction toward the inner side in the vehicle width direction above the side end edge 122*a*1 and a lower end edge that extends parallel to the boundary line B slightly below the boundary line B. The first sub-reflection region 130Aa1 is composed of a plurality of reflective elements 130As1 partitioned into vertical stripes.

The second sub-reflection region 130Aa2 is disposed at a position where it interests with the inclined plane P2 including the right side end edge 122*a*1 of the light-emitting surface 122*a* of the first light-emitting element 122 and inclined upward by 15° with respect to the horizontal plane. At that time, the second sub-reflection region 130Aa2 has a lower end edge that coincides with the upper end edge of the first sub-reflection region 130Aa1 and an upper end edge that extends at an inclination angle slightly larger than the inclined plane P2 toward the inner side in the vehicle width direction. The second sub-reflection region 130Aa2 is composed of a plurality of reflective elements 130As2 partitioned into oblique vertical stripes in a direction orthogonal to the inclined plane P2.

The third and fourth sub-reflection regions 130Aa3, 130Aa4 have substantially the same configuration as the third and fourth sub-reflection region 30Aa3, 30Aa4 of the above embodiment.

Also in the case of adopting the configuration of the present modification, substantially the same operation effects as those of the first embodiment can be obtained.

Next, a second embodiment of the present invention will be described.

Figure 6:
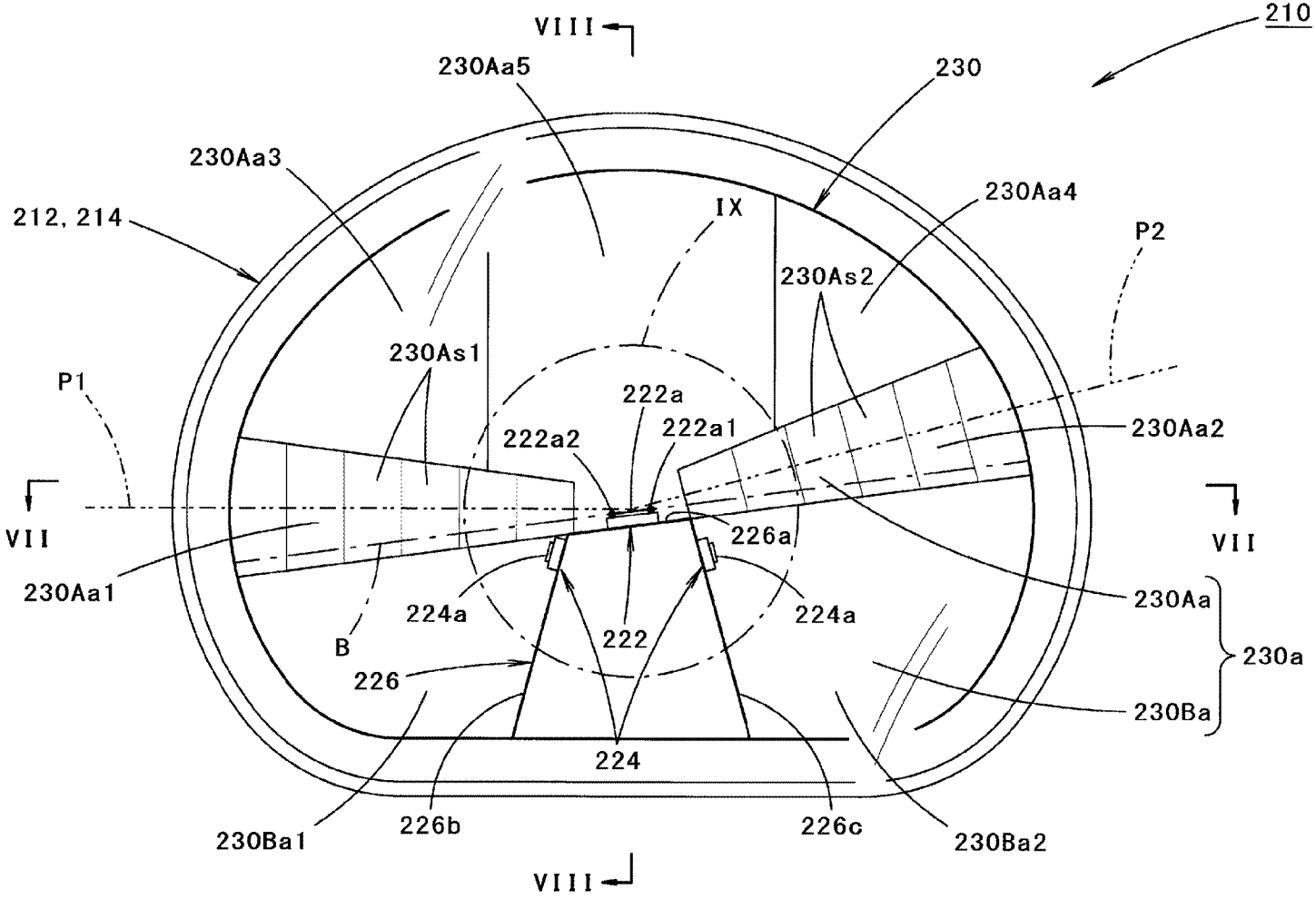
FIG. 6 is a front view showing a vehicle lamp according to a second embodiment of the present invention.
Figure 8:
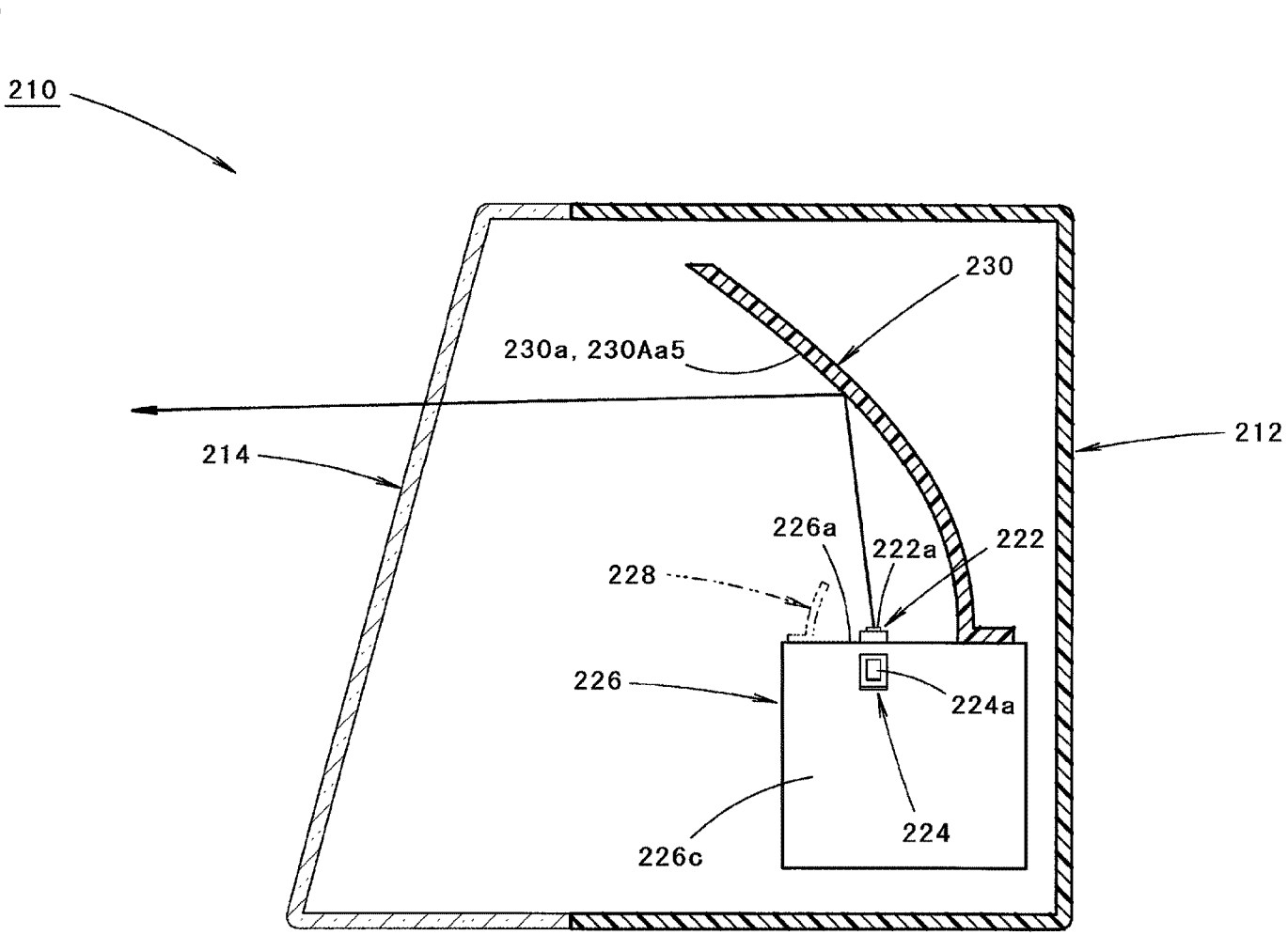
FIG. 8 is a sectional view taken along the line VIII-VIII shown in FIG. 6.
Figure 9:
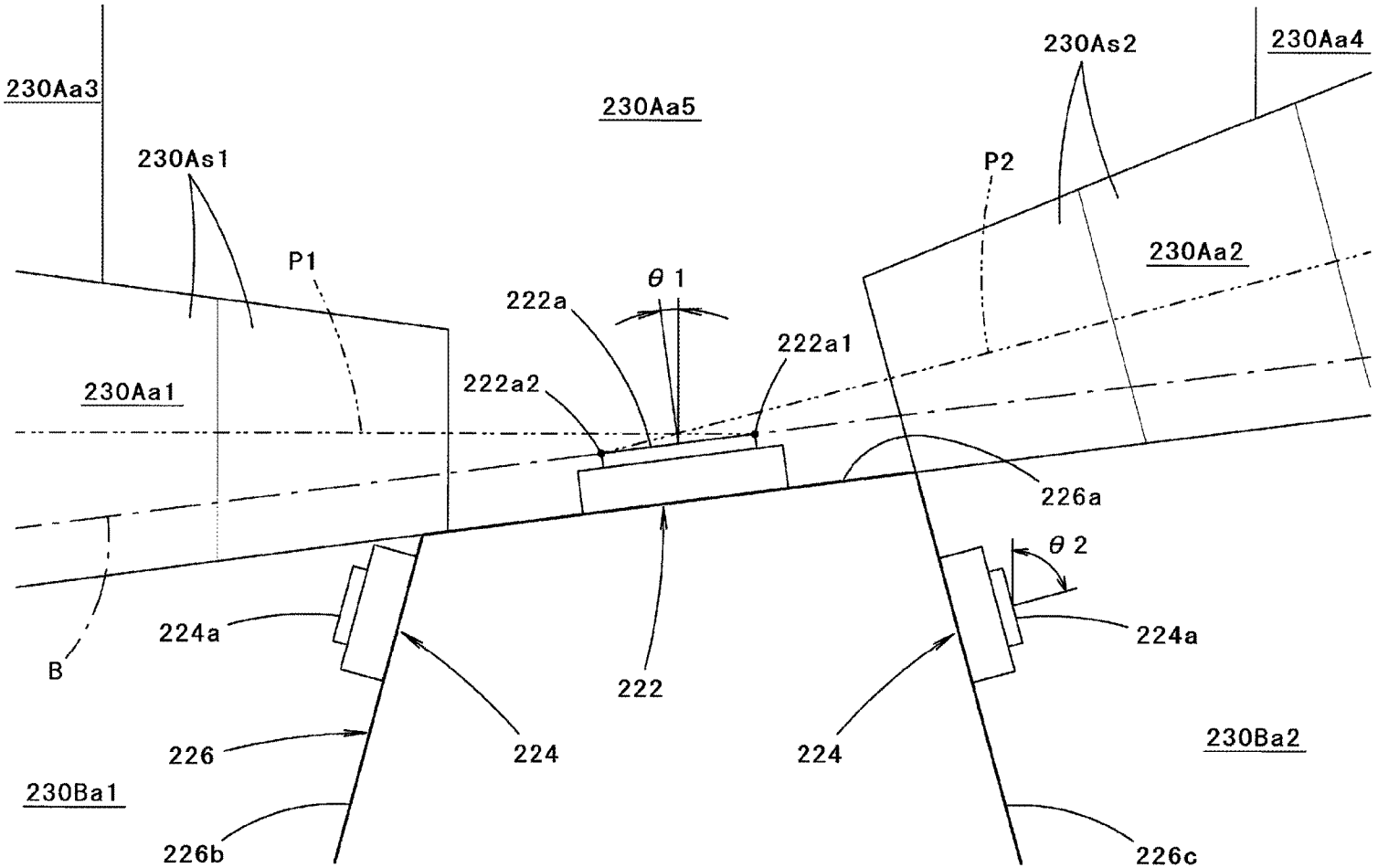
FIG. 9 is a detailed view of the IX part shown in FIG. 6.

FIG. 6 is a front view showing a vehicle lamp 210 according to the present embodiment. Further, FIG. 7 is a sectional view taken along the line shown in FIG. 6, and FIG. 8 is a sectional view taken along the line VIII-VIII shown in FIG. 6. Further, FIG. 9 is a detailed view of the IX part shown in FIG. 6.

As shown in these figures, the vehicle lamp 210 according to the present embodiment is a headlamp disposed at the left front end portion of a vehicle, and is configured to be able to selectively perform the low-beam irradiation and the high-beam irradiation.

The vehicle lamp 210 has a configuration in which first and second light-emitting elements 222, 224 and a reflector 230 for reflecting light emitted from these first and second light-emitting elements 222, 224 toward the front are incorporated in a lamp chamber which is defined by a lamp body 212 and a plain translucent cover 214 attached to a front end opening thereof. At that time, in the present embodiment, two second light-emitting elements 224 are disposed.

Then, the vehicle lamp 210 has a configuration in which a low-beam light distribution pattern having horizontal and oblique cutoff lines is forming by turning on the first light-emitting element 222 and a high-beam light distribution pattern is formed by turning on the second light-emitting element 224.

As shown in FIG. 7, the translucent cover 214 is formed so as to extend rearward in a slightly inclined manner from the inner side (i.e., right side) in the vehicle width direction toward the outer side in the vehicle width direction.

The first light-emitting element 222 is a white light-emitting diode and has the same configuration as the first light-emitting element 22 of the first embodiment.

Each of the second light-emitting elements 224 is a white light-emitting diode and has an elongated rectangular light-emitting surface 224*a*. A ratio between the long side and the short side of the light-emitting surface 224*a* is set to a value smaller than in the second light-emitting element 224 of the first embodiment.

The first light-emitting element 222 and the two second light-emitting elements 224 are disposed at the central rear portion in the lamp chamber and are supported on a common heat sink 226.

The first light-emitting element 222 is disposed on an upper surface 226*a* of the heat sink 226 in a state where its light-emitting surface 222*a* is inclined to the right side ("left side" in the front view of the lamp) with respect to a vertically upward direction. At that time, the inclination angle θ1 of the normal direction of the light-emitting surface 222*a* to the vertically upward direction is set to a value (e.g., a value of about 7.5°) of $0 \leq \theta 1 \leq 15°$. In addition, the first light-emitting element 222 is disposed in a state where its light-emitting surface 222*a* is elongated in the right and left directions. Therefore, a side end edge 222*a*1 constituting the short side on the outer side in the vehicle width direction of the light-emitting surface 232*a* and a side end edge 222*a*2 constituting the short side on the inner side in the vehicle width direction are constituted by horizontal lines extending in the front and rear directions.

The two second light-emitting elements 224 are disposed at positions on the obliquely right lower side and obliquely left lower side of the first light-emitting element 222 and on a right surface 226*b* and a left surface 226*c* of the heat sink 226 in a state where the normal direction of the light-emitting surface 224*a* thereof is oriented in a direction closer to the horizontal direction than the normal direction of the light-emitting surface 222*a* of the first light-emitting element 222. At that time, these two second light-emitting elements 224 are arranged in a bilateral-symmetrical positional relationship, and the inclination angle θ2 of the light-emitting surface 224*a* thereof to the vertically upward direction is set to a value (e.g., a value of about 80°) of $45° \leq \theta 2 \leq 90°$. Further, each of these second light-emitting elements 224 is disposed in a state where its light-emitting surface 224*a* is elongated in a direction orthogonal to the front and rear directions.

The reflector 230 is formed so as to extend to the left and right sides from the rear of the first and second light-emitting elements 222 and 224 toward the front end portion in the lamp chamber.

A reflecting surface 230*a* of the reflector 230 has a first reflection region 230Aa on which light emitted from the first light-emitting element 222 is incident and a second reflection region 230Ba on which the light emitted from the first light-emitting element 222 is not incident but light emitted from the two second light-emitting elements 224 is incident. At this time, a boundary line B between the first reflection region 230Aa and the second reflection region 230Ba is set to a position where an extension plane of the light-emitting surface 222*a* of the first light-emitting element 222 intersects with the reflecting surface 230*a*, as indicated by a chain line in FIGS. 6 and 9.

The first reflection region 230Aa has a first sub-reflection region 230Aa1 for forming the horizontal cutoff line and a second sub-reflection region 230Aa2 for forming the oblique cutoff line.

The first and second sub-reflection regions 230Aa1, 230Aa2 are disposed at positions on the left and right sides with respect to the first light-emitting element 222. Then, the first and second sub-reflection regions 230Aa1, 230Aa2 are formed over a range from a position somewhat distant to the left and right sides from the first light-emitting element 222 to each end edge position on the left and right sides of the reflecting surface 230*a*.

The first sub-reflection region 230Aa1 is disposed on the right side of the first light-emitting element 222 at a position where it intersects with the horizontal plane P1 (indicated by a two-dot chain line in FIGS. 6 and 9) including the side end edge 222*a*1 of the light-emitting surface 222*a* thereof. At that time, the first sub-reflection region 230Aa1 has an upper end edge that extends slightly upward with respect to the horizontal direction toward the inner side in the vehicle width direction above the side end edge 222*a*1 and a lower end edge that is set to a position (i.e., a position slightly below the boundary line B) where it intersects with an extension plane of the upper surface 226*a* of the heat sink 226.

The first sub-reflection region 230Aa1 is composed of a plurality of reflective elements 230As1 partitioned into vertical stripes. Then, each of these reflective elements 230As1 is adapted to reflect the light emitted from the first light-emitting element 222 toward the front as light that is slightly deflected downward and diffused and/or deflected in the horizontal direction.

The second sub-reflection region 230Aa2 is disposed on the left side of the first light-emitting element 222 at a position where it intersects with the inclined plane P2 (indicated by a two-dot chain line in FIGS. 6 and 9) including the side end edge 222*a*1 of the light-emitting surface 222*a* thereof and inclined upward by 15° with respect to the horizontal plane. At that time, the second sub-reflection region 230Aa2 has an upper end edge that extends upward at an inclined angle slightly larger than the inclined plane P2 toward the outer side in the vehicle width direction and a lower end edge that is set to a position where it intersects with the extension plane of the lower surface 226*a* of the heat sink 226.

The second sub-reflection region 230Aa2 is composed of a plurality of reflective elements 230As2 partitioned into oblique vertical stripes in a direction orthogonal to the inclined plane P2. Then, each of these reflective elements 230As2 is adapted to reflect the light emitted from the first light-emitting element 222 toward the front as light that is slightly deflected downward and diffused and/or deflected in a direction along the inclined plane P2.

The first reflection region 230Aa has a third sub-reflection region 230Aa3 adjacent to the upper side of the first sub-reflection region 230Aa1, a fourth sub-reflection region 230Aa4 adjacent to the upper side of the second sub-reflection region 230Aa2, and a fifth sub-reflection region 230Aa5 disposed between the third and fourth sub-reflection region 230Aa3, 230Aa4, in addition to the first and second sub-reflection regions 230Aa1, 230Aa2. At that time, a lower end edge of the fifth sub-reflection region 230Aa5 is set to a position where it intersects with the extension plane of the upper surface 226*a* of the heat sink 226.

The third and fourth sub-reflection regions 230Aa3, 230Aa4 are adapted to reflect the light emitted from the first light-emitting element 222 toward the front as light that is slightly deflected downward and is relatively largely diffused in the right and left directions. Further, the fifth sub-reflection region 230Aa5 is adapted to reflect the light emitted from the first light-emitting element 222 toward the front as light that is slightly deflected downward and is largely diffused in the right and left directions.

On the other hand, the second reflection region 230Ba has a first sub-reflection region 230Ba1 disposed at a position adjacent to the lower side of the first sub-reflection region 230Aa1 on the right side of a right surface 226*b* of the heat sink 226 and a second sub-reflection region 230Ba2 disposed at a position adjacent to the lower side of the second sub-reflection region 230Aa2 on the left side of a left surface 226*c* of the heat sink 226.

The first sub-reflection region 230Ba1 is adapted to reflect light emitted from the right second light-emitting element 224 toward the front as light that is slightly diffused in the right and left directions, and the second sub-reflection region 230Ba2 is adapted to reflect light emitted from the left second light-emitting element 224 toward the front as light that is slightly diffused in the right and left directions.

Figure 10A:
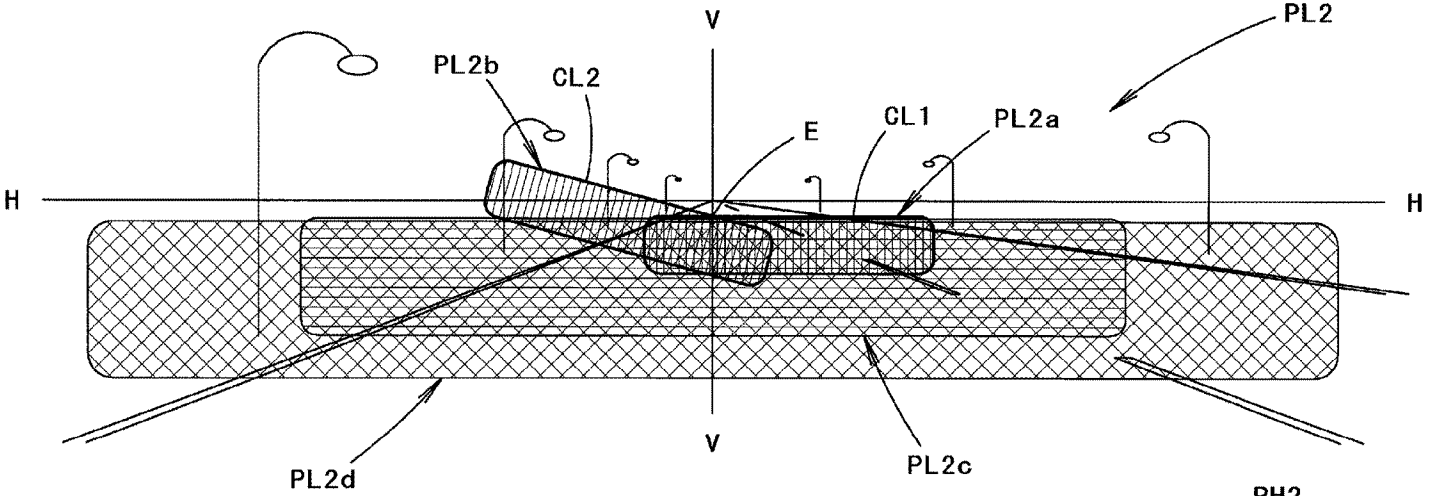
FIGS. 10A and 10B are views similar to FIGS. 4A and 4B, showing a function of the second embodiment.
Figure 10B:
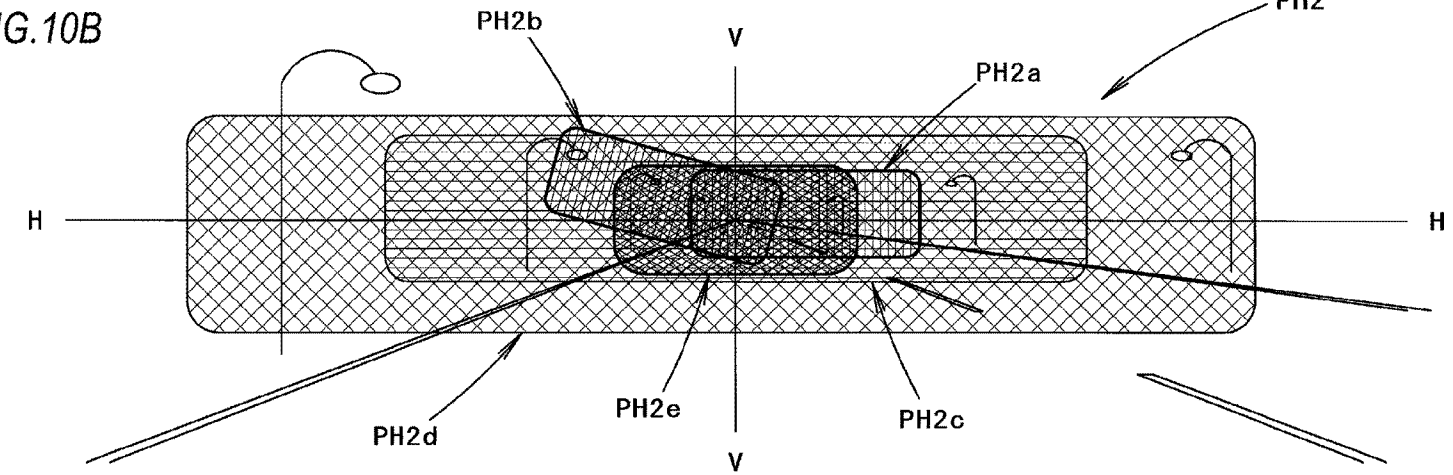

FIGS. 10A and 10B are views transparently showing a light distribution pattern which is formed on the virtual vertical screen by light irradiated forward from the vehicle lamp 210.

A low-beam light distribution pattern PL2 shown in FIG. 10A is a low-beam light distribution pattern of left light distribution and is formed as a combined light distribution pattern of four light distribution patterns PL2*a*, PL2*b*, PL2*c*, PL2*d* formed by turning on the first light-emitting element 222.

The light distribution pattern PL2*a* is a light distribution pattern formed by light reflected from the first sub-reflection region 230Aa1 and has substantially the same shape as the light distribution pattern PL1*a* of the first embodiment.

The light distribution pattern PL2*b* is a light distribution pattern formed by light reflected from the second sub-reflection region 230Aa2 and has substantially the same shape as the light distribution pattern PL1*b* of the first embodiment.

The light distribution pattern PL2*c* is a light distribution pattern formed by light reflected from the third and fourth sub-reflection regions 230Aa3, 230Aa4 and has substantially the same shape as the light distribution pattern PL1*c* of the first embodiment.

The light distribution pattern PL2*d* is a light distribution pattern formed by light reflected from the fifth sub-reflection region 230Aa5 and has substantially the same shape as the light distribution pattern PL1*d* of the first embodiment.

A high-beam light distribution pattern PH2 shown in FIG. 10B is formed as a laterally elongated light distribution pattern spreading to the left and sides around the H-V.

The high-beam light distribution pattern PH2 is formed as a combined light distribution pattern of five light distribution patterns PH2*a*, PH2*b*, PH2*c*, PH2*d*, PH2*e* formed by turning on the second light-emitting element 224.

Four light distribution patterns PH2*a* to PH2*d* are light distribution patterns formed by the light reflected from the first to fifth sub-reflection regions 230Aa1 to 230Aa5.

Each of these light distribution patterns PH2*a* to PH2*d* is formed as a light distribution pattern that is obtained by displacing, slightly upward, each of the light distribution patterns PL2*a* to PL2*d* formed by turning on the first light-emitting element 222, making a vertical width thereof slightly wider, and reducing a diffusion angle thereof in the right and left directions.

The remaining one light distribution pattern PH2*e* is a light distribution pattern that is formed by the light reflected from the first and second sub-reflection regions 230Ba1, 230Ba2 of the second reflection region 230Ba.

The light distribution pattern PH2*e* is formed as a slightly laterally elongated light distribution pattern centered on the H-V. At that time, the light distribution pattern PH2*e* is formed as a spot-like bright light distribution pattern.

The light distribution patterns PH2*e* is superposed on the position of the H-V with respect to the four light distribution patterns PH2*a* to PH2*d*, so that a deviation in the luminous intensity distribution of the four light distribution patterns PH2*a* to PH2*d* is corrected. In this way, the high-beam light distribution pattern PH2 is formed as a light distribution pattern which has a suitable luminous intensity distribution where the luminous intensity is the highest in the vicinity of the H-V and is gradually decreased toward the peripheral region thereof.

Next, operational effects of the present embodiment will be described.

Also in the present embodiment, the low-beam light distribution pattern PL2 having the horizontal and oblique cutoff lines CL1, CL2 can be formed by reflecting light emitted from the first light-emitting element 222 at the first reflection region 230Aa. Therefore, the cost can be reduced, as compared to the conventional vehicle lamp.

Further, since the second reflection region 230Ba can be used as a dedicated region for reflectively controlling the light emitted from two second light-emitting elements 224, it is possible to form the high-beam light distribution pattern PH2 with a required luminous intensity distribution.

Therefore, also in the case of adopting the configuration of the present embodiment, substantially the same operation effects as those of the first embodiment can be obtained.

Also in the present embodiment, since the first sub-reflection region 230Aa1 is disposed at a position where it intersects with the horizontal plane P1 including the side end edge 222*a*1 of the light-emitting surface 222*a* of the first light-emitting element 222, which is a first side end edge located on the side opposite to the first sub-reflection region 230Aa1 in the right and left directions, the light distribution pattern PL2*a* having the clear horizontal cutoff line CL1 can be formed as a light distribution pattern having a small vertical width by reflectively controlling the light emitted from the first light-emitting element 222 at the first sub-reflection region 230Aa1.

Similarly, since the second sub-reflection region 230Aa2 is disposed at a position where it intersects with the inclined plane P2 including the side end edge 222*a*2 of the light-emitting surface 222*a* of the first light-emitting element 222, which is a second side end edge located on the side opposite to the second sub-reflection region 230Aa2 in the right and left directions, the light distribution pattern PL2*b* having the clear horizontal cutoff line CL2 can be formed as a light distribution pattern having a small vertical width by reflectively controlling the light emitted from the first light-emitting element 222 at the second sub-reflection region 230Aa2.

Then, as described above, by forming the light distribution pattern PL2*a* having the clear horizontal cutoff line CL1 and the light distribution pattern PL2*b* having the clear oblique cutoff line CL2 as the light distribution pattern having a small vertical width, it is possible to previously prevent the front region of the low-beam light distribution pattern PL2 from becoming excessively bright. Thus, the forward visibility can be improved.

Also in the present embodiment, the light-emitting surface 222*a* of the first light-emitting element 222 has an outer shape that is longer in the right and left directions than in the front and rear directions. Therefore, similar to the first embodiment, the brightness of the light distribution patterns PL2*a*, PL2*b* can be increased and the front region of the low-beam light distribution pattern PL2 can be prevented from becoming excessively bright.

Also in the present embodiment, the light-emitting surface 224*a* of each second light-emitting element 224 has the normal direction that is oriented in a direction closer to a horizontal direction than the normal direction of the light-emitting surface 222*a* of the first light-emitting element 222. Therefore, it is possible to easily secure, in the reflecting surface 230*a* of the reflector 230, the second reflection region 230Ba on which light emitted from the first light-emitting element 222 is not incident and light emitted from the second light-emitting element 224 is incident.

Particularly in the present embodiment, the first sub-reflection region 230Ba1 located on the right side of the second reflection region 230Ba can be used as a dedicated region for reflectively controlling the light emitted from the right second light-emitting element 224 and the second sub-reflection region 230Ba2 located on the left side thereof can be used as a dedicated region for reflectively controlling the light emitted from the left second light-emitting element 224. Therefore, it is possible to more easily form the high-beam light distribution pattern PH2 with a required luminous intensity distribution.

Also in the present embodiment, the light-emitting surface 224*a* of the second light-emitting element 224 has an outer shape that is longer in the direction orthogonal to the front and rear directions than in the front and rear directions. Therefore, each of the light distribution patterns PH2*a* to PH2*e* formed by the light, which is emitted from the second light-emitting element 224 and reflected by the first and second reflection regions 230Aa, 230Ba, can be easily formed as a light distribution pattern having a relatively large vertical width. In this way, it is possible to more easily form the high-beam light distribution pattern PH2 with a required luminous intensity distribution.

When the first and second sub-reflection regions 230Aa1, 230Aa2 are disposed on opposite sides in the right and left directions with respect to the first light-emitting element 222 as in the present embodiment, the shape of the reflector 230 can be easily formed into a shape close to a bilaterally symmetrical shape. Therefore, as a configuration of a vehicle lamp disposed at a right front end portion of a vehicle, it is possible to adopt a configuration in which only the outer shape of the reflector 230 is reversed left and right, and then, the configuration of the vehicle lamp 210 is translated as it is.

Meanwhile, the present embodiment may have a configuration in which a shade 228 is disposed in front of the first light-emitting element 222 on the upper surface 226*a* of the heat sink 226, as indicated by a two-dot chain line in FIG. 8, and direct light emitted obliquely forward and upward from the first light-emitting element 222 is shielded by the shade 228.

Next, a third embodiment of the present invention will be described.

Figure 11:
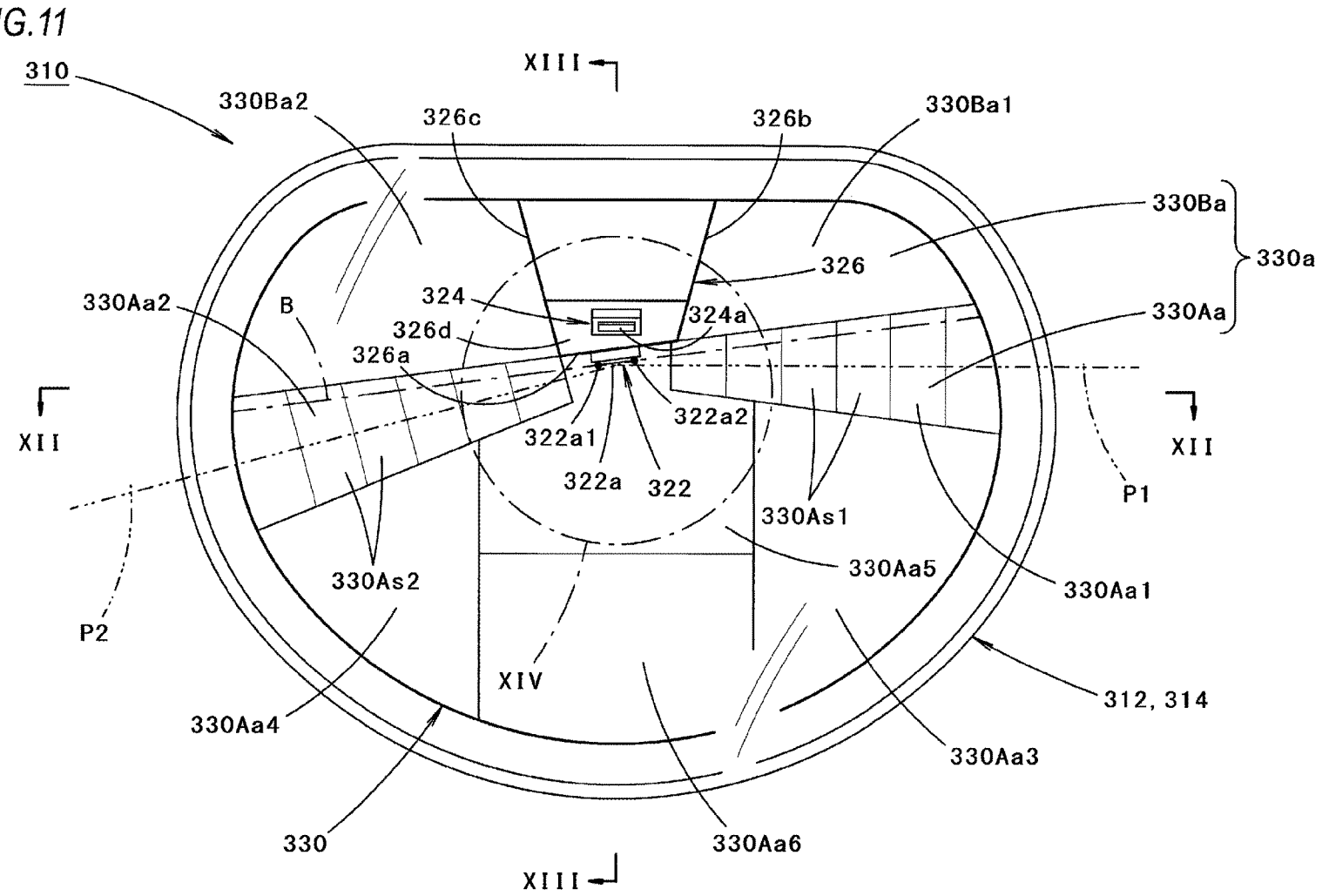
FIG. 11 is a front view showing a vehicle lamp according to a third embodiment of the present invention.
Figure 13:
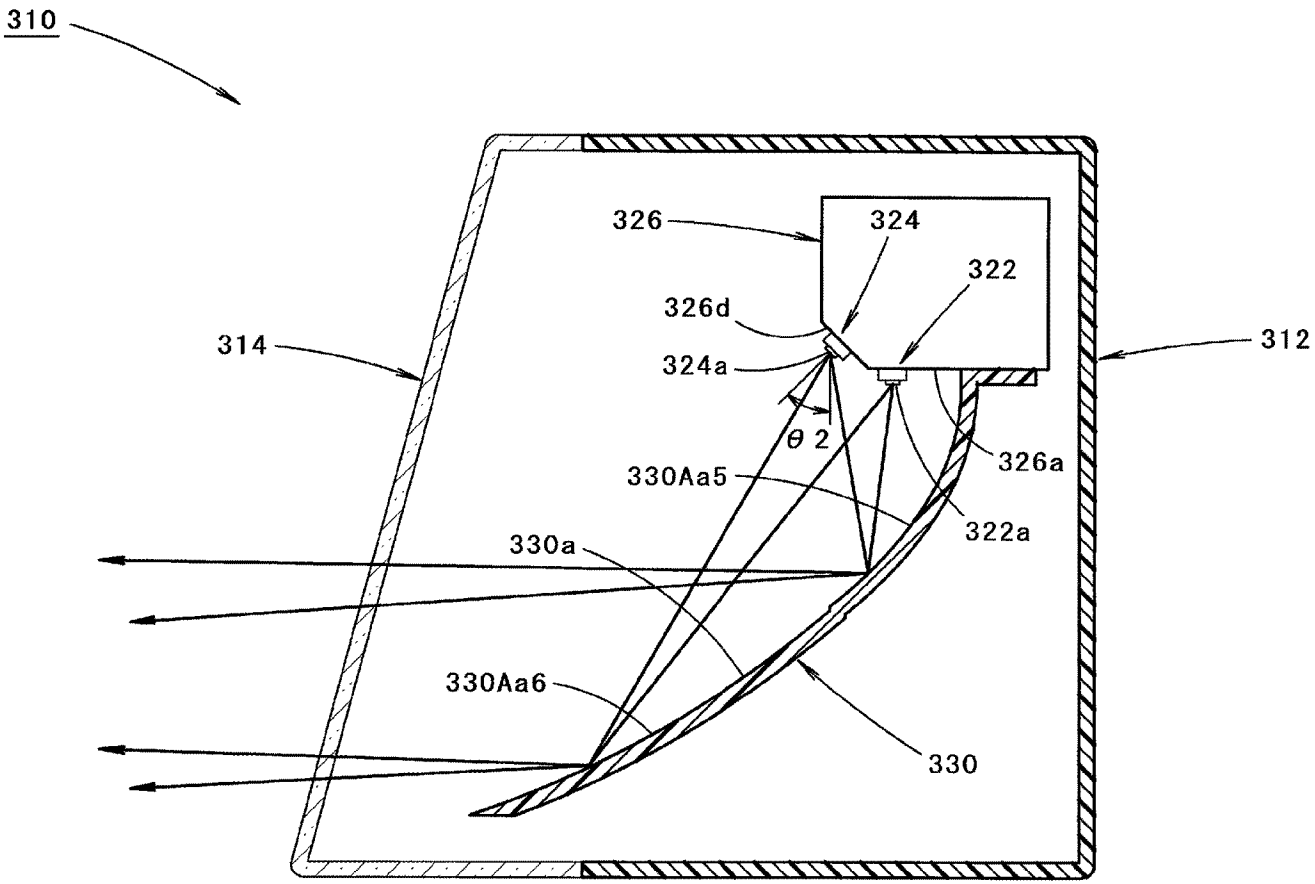
FIG. 13 is a sectional view taken along the line XIII-XIII shown in FIG. 11.
Figure 14:
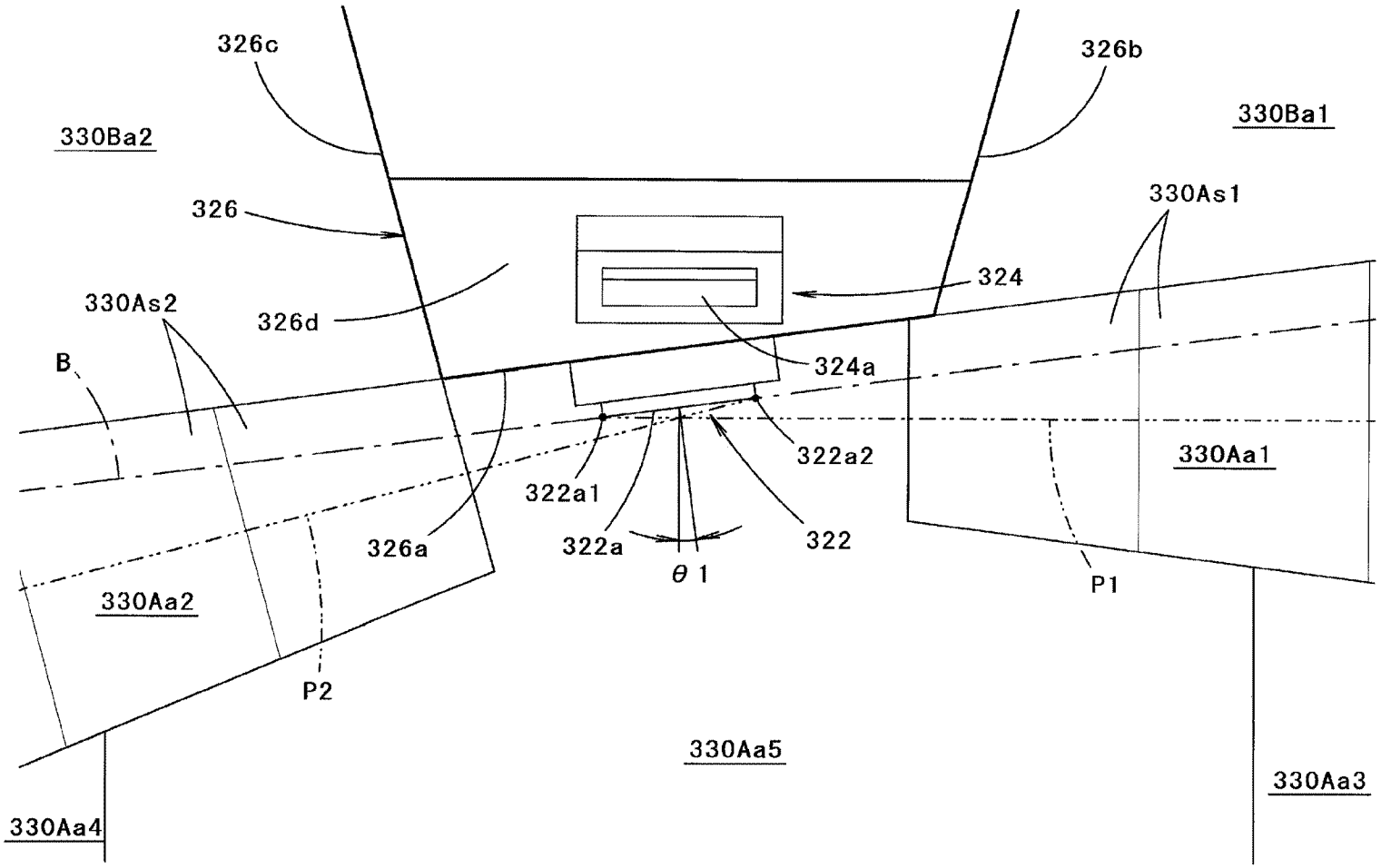
FIG. 14 is a detailed view of the XIV part shown in FIG. 11.

FIG. 11 is a front view showing a vehicle lamp 310 according to the present embodiment. Further, FIG. 12 is a sectional view taken along the line XII-XII shown in FIG. 11, and FIG. 13 is a sectional view taken along the line XIII-XIII shown in FIG. 11. Further, FIG. 14 is a detailed view of the XIV part shown in FIG. 11.

As shown in these figures, the vehicle lamp 310 according to the present embodiment is a headlamp disposed at the left front end portion of the vehicle, and is configured to be able to selectively perform the low-beam irradiation and the high-beam irradiation.

The vehicle lamp 310 has a configuration in which first and second light-emitting elements 322, 324 and a reflector 330 for reflecting light emitted from these first and second light-emitting elements 322, 324 toward the front are incorporated in a lamp chamber which is defined by a lamp body 312 and a plain translucent cover 314 attached to a front end opening thereof.

Then, the vehicle lamp 310 has a configuration in which a low-beam light distribution pattern having horizontal and oblique cutoff lines is formed by turning on the first light-emitting element 322 and a high-beam light distribution pattern is formed by turning on the second light-emitting element 324.

As shown in FIG. 12, the translucent cover 314 is formed so as to extend rearward in a slightly inclined manner from the inner side (i.e., right side) in the vehicle width direction toward the outer side in the vehicle width direction.

Both the first and second light-emitting elements 322, 324 are white light-emitting diodes and have the same configuration as the first and second light-emitting elements 22, 24 of the first embodiment.

The first light-emitting element 322 and second light-emitting elements 324 are disposed at the central rear portion in the lamp chamber and are supported on a common heat sink 326.

The first light-emitting element 322 is disposed on a lower surface 326*a* of the heat sink 326 in a state where its light-emitting surface 322*a* is inclined to the left side ("right side" in the front view of the lamp) with respect to a vertically downward direction. At that time, the inclination angle θ1 of the normal direction of the light-emitting surface 322*a* to the vertically downward direction is set to a value (e.g., a value of about 7.5°) of $0° \leq \theta 1 \leq 15°$. In addition, the first light-emitting element 322 is disposed in a state where its light-emitting surface 322*a* is elongated in the right and left directions. Therefore, a side end edge 322*a*1 constituting the short side on the inner side in the vehicle width direction of the light-emitting surface 322*a* and a side end edge 322*a*2 constituting the short side on the outer side in the vehicle width direction are constituted by horizontal lines extending in the front and rear directions.

The second light-emitting element 324 is disposed at a position on the diagonally upper front side of the first light-emitting element 322 and on a front inclined surface 326*b* of the heat sink 326 in a state where the normal direction of the light-emitting surface 324*a* thereof is oriented in a direction closer to the horizontal direction than the normal direction of the light-emitting surface 322*a* of the first light-emitting element 322. At that time, the inclination angle θ2 of the light-emitting surface 324*a* to the vertically downward direction is set to a value (e.g., a value of about 45°) of $30° \leq \theta 2 \leq 60°$. Further, second light-emitting elements 324 is disposed in a state where its light-emitting surface 324*a* is elongated in a direction orthogonal to the front and rear directions.

The reflector 330 is formed so as to extend to the left and right sides from the rear of the first and second light-emitting elements 322 and 324 toward the front end portion in the lamp chamber.

A reflecting surface 330*a* of the reflector 330 has a first reflection region 330Aa on which light emitted from the first light-emitting element 322 is incident and a second reflection region 330Ba on which the light emitted from the first light-emitting element 322 is not incident but light emitted from the second light-emitting elements 324 is incident. At this time, a boundary line B between the first reflection region 330Aa and the second reflection region 330Ba is set to a position where an extension plane of the light-emitting surface 322*a* of the first light-emitting element 322 intersects with the reflecting surface 330*a*, as indicated by a chain line in FIGS. 11 and 14.

The first reflection region 330Aa has a first sub-reflection region 330Aa1 for forming the horizontal cutoff line and a second sub-reflection region 330Aa2 for forming the oblique cutoff line.

The first and second sub-reflection regions 330Aa1, 330Aa2 are disposed at positions on the left and right sides with respect to the first and second light-emitting elements 322, 324. Then, the first and second sub-reflection regions 330Aa1, 330Aa2 are formed over a range from a position somewhat distant to the left and right sides from the first light-emitting element 322 to each end edge position on the left and right sides of the reflecting surface 330*a*.

The first sub-reflection region 330Aa1 is disposed on the left side of the first light-emitting element 322 at a position where it intersects with the horizontal plane P1 (indicated by a two-dot chain line in FIGS. 11 and 14) including the side end edge 322*a*1 of the light-emitting surface 322*a* thereof. At that time, the first sub-reflection region 330Aa1 has an upper end edge that is set to a position (i.e., a position slightly above the boundary line B) where it intersects with an extension plane of the lower surface 326*a* of the heat sink 326 and a lower end edge that extends slightly downward with respect to the horizontal direction toward the outer side in the vehicle width direction below the side end edge 322*a*1.

The first sub-reflection region 330Aa1 is composed of a plurality of reflective elements 330As1 partitioned into vertical stripes. Then, each of these reflective elements 330As1 is adapted to reflect the light emitted from the first light-emitting element 322 toward the front as light that is slightly deflected downward and diffused and/or deflected in the horizontal direction.

The second sub-reflection region 330Aa2 is disposed on the right side of the first light-emitting element 322 at a position where it intersects with the inclined plane P2 (indicated by a two-dot chain line in FIGS. 11 and 14) including the side end edge 322*a*1 of the light-emitting surface 322*a* of the first light-emitting element 322 and inclined downward by 15° with respect to the horizontal plane. At that time, the second sub-reflection region 330Aa2 has an upper end edge that is set to a position where it intersects with the extension plane of the lower surface 326*a* of the heat sink 326 and a lower end edge that extends downward at an inclined angle slightly larger than the inclined plane P2 toward the inner side in the vehicle width direction.

The second sub-reflection region 330Aa2 is composed of a plurality of reflective elements 330As2 partitioned into oblique vertical stripes in a direction orthogonal to the inclined plane P2. Then, each of these reflective elements 330As2 is adapted to reflect the light emitted from the first light-emitting element 322 toward the front as light that is slightly deflected downward and diffused and/or deflected in a direction along the inclined plane P2.

The first reflection region 330Aa has a third sub-reflection region 330Aa3 adjacent to the lower side of the first sub-reflection region 330Aa1, a fourth sub-reflection region 330Aa4 adjacent to the lower side of the second sub-reflection region 330Aa2, and fifth and sixth sub-reflection region 330Aa5, 330Aa6 disposed in the upper and lower two stages between the third and fourth sub-reflection region 330Aa3, 330Aa4, in addition to the first and second sub-reflection regions 330Aa1, 330Aa2. At that time, an upper end edge of the fifth sub-reflection region 330Aa5 located on the upper side is set to a position where it intersects with the extension plane of the lower surface 326*a* of the heat sink 326 and a lower end edge of the sixth sub-reflection region 330Aa6 extends to a front end edge position of the reflecting surface 330*a*.

The third and fourth sub-reflection regions 330Aa3, 330Aa4 are adapted to reflect the light emitted from the first light-emitting element 322 toward the front as light that is slightly deflected downward and is relatively largely diffused in the right and left directions. Further, the fifth sub-reflection region 330Aa5 is adapted to reflect the light emitted from the first light-emitting element 322 toward the front as light that is slightly diffused downward and is largely diffused in the right and left directions. Further, the sixth sub-reflection region 330Aa6 is adapted to reflect the light emitted from the first light-emitting element 322 toward the front as light that is slightly deflected downward.

On the other hand, the second reflection region 330Ba has a first sub-reflection region 330Ba1 disposed at a position adjacent to the upper side of the first sub-reflection region 330Aa1 on the left side of a left surface 326*b* of the heat sink 326 and a second sub-reflection region 330Ba2 disposed at a position adjacent to the upper side of the second sub-reflection region 330Aa2 on the right side of a right surface 326*c* of the heat sink 326.

These fast and second sub-reflection regions 330Ba1, 330Ba2 are adapted to reflect the light emitted from the second light-emitting element 324 toward the front as light that is slightly diffused in the right and left directions.

Figure 15A:
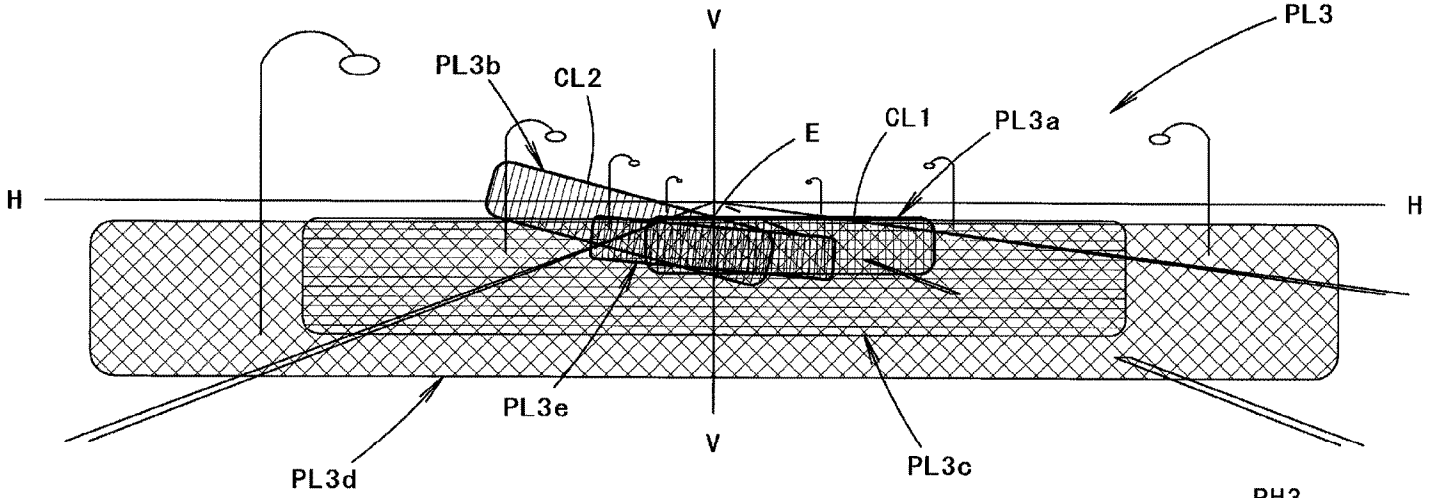
FIGS. 15A and 15B are views similar to FIGS. 4A and 4B, showing a function of the third embodiment.
Figure 15B:
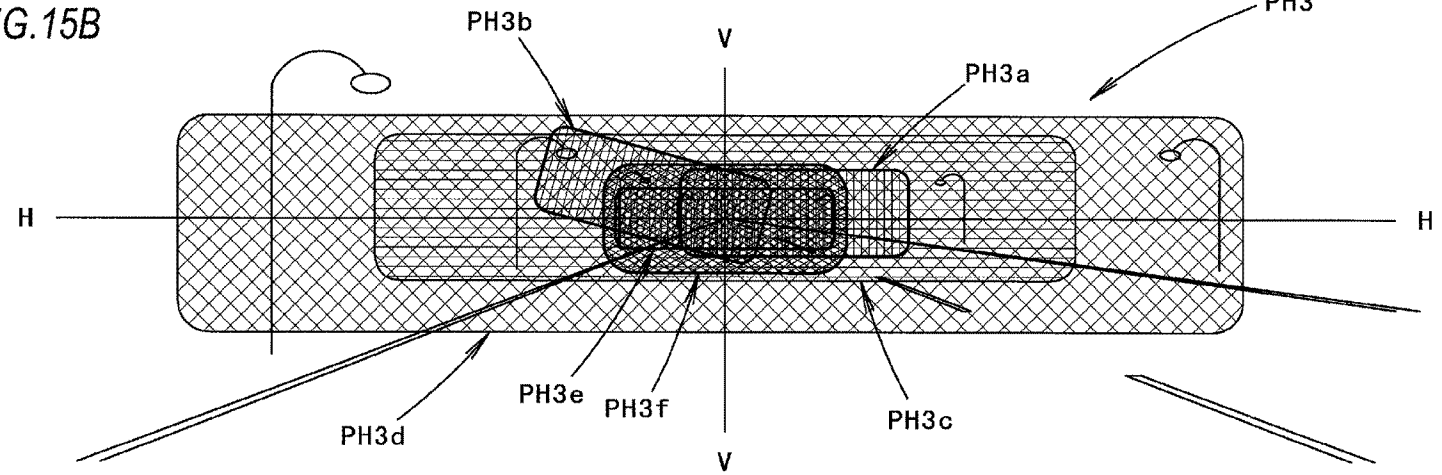

FIGS. 15A and 15B are views transparently showing a light distribution pattern which is formed on the virtual vertical screen by light irradiated forward from the vehicle lamp 310.

A low-beam light distribution pattern PL3 shown in FIG. 15A is a low-beam light distribution pattern of left light distribution and is formed as a combined light distribution pattern of five light distribution patterns PL3*a*, PL3*b*, PL3*c*, PL3*d*, PL3*e* formed by turning on the first light-emitting element 322.

The light distribution pattern PL3*a* is a light distribution pattern that is formed by light reflected from the first sub-reflection region 330Aa1 and has substantially the same shape as the light distribution pattern PL1*a* of the first embodiment.

The light distribution pattern PL3*b* is a light distribution pattern that is formed by light reflected from the second sub-reflection region 330Aa2 and has substantially the same shape as the light distribution pattern PL1*b* of the first embodiment.

The light distribution pattern PL3*c* is a light distribution pattern that is formed by light reflected from the third and fourth sub-reflection regions 330Aa3, 330Aa4 and has substantially the same shape as the light distribution pattern PL1*c* of the first embodiment.

The light distribution pattern PL3*d* is a light distribution pattern that is formed by light reflected from the fifth sub-reflection region 330Aa5 and has substantially the same shape as the light distribution pattern PL1*d* of the first embodiment.

The light distribution pattern PL3*e* is a light distribution pattern that is formed by light reflected from the sixth sub-reflection region 330Aa6 and is formed near the lower side of the elbow point E. At that time, the light distribution pattern PL3*e* is formed as a spot-like relatively bright light distribution pattern which has a small vertical width and has an inclined angle smaller than the light distribution pattern PL3*b*.

A high-beam light distribution pattern PH3 shown in FIG. 15B is formed as a laterally elongated light distribution pattern spreading to the left and sides around the H-V.

The high-beam light distribution pattern PH3 is formed as a combined light distribution pattern of six light distribution patterns PH3*a*, PH3*b*, PH3*c*, PH3*d*, PH3*e*, PH3*f* formed by turning on the second light-emitting element 324.

Four light distribution patterns PH3*a* to PH3*d* are light distribution patterns formed by the light reflected from the first to fifth sub-reflection region 330Aa1 to 330Aa5.

Each of these light distribution patterns PH3*a* to PH3*d* is formed as a light distribution pattern that is obtained by displacing, slightly upward, each of the light distribution patterns PL3*a* to PL3*d* formed by turning on the first light-emitting element 322, making a vertical width thereof slightly wider, and reducing a diffusion angle thereof in the right and left directions.

On the other hand, the light distribution pattern PH3*e* formed by the light reflected from the sixth sub-reflection region 330Aa6 is formed as a spot-like bright light distribution pattern with a narrow vertical width around the H-V.

The remaining one light distribution pattern PH3*f* is a light distribution pattern that is formed by the light reflected from the first and second sub-reflection regions 330Ba1, 330Ba2 of the second reflection region 330Ba.

The light distribution pattern PH3*f* is formed as a slightly laterally elongated light distribution pattern centered on the H-V. At that time, the light distribution pattern PH3*f* is formed as a spot-like bright light distribution pattern.

These two light distribution patterns PH3*e*, PH3*f* are superposed on the position of the H-V with respect to the four light distribution patterns PH3*a* to PH3*d*, so that a deviation in the luminous intensity distribution of the four light distribution patterns PH3*a* to PH3*d* is corrected. In this way, the high-beam light distribution pattern PH3 is formed as a light distribution pattern that has a suitable luminous intensity distribution where the luminous intensity is the highest in the vicinity of the H-V and is gradually decreased toward the peripheral region thereof.

Next, operational effects of the present embodiment will be described.

Also in the vehicle lamp 310 according to the present embodiment, the low-beam light distribution pattern PL3 having the horizontal and oblique cutoff lines CL1, CL2 can be formed by reflecting light emitted from the first light-emitting element 322 at the first reflection region 330Aa. Therefore, the cost can be reduced, as compared to the conventional vehicle lamp.

Further, since the second reflection region 330Ba can be used as a dedicated region for reflectively controlling the light emitted from the second light-emitting element 324, it is possible to form the high-beam light distribution pattern PH3 with a required luminous intensity distribution.

Therefore, also in the case of adopting the configuration of the present embodiment, substantially the same operation effects as those of the first embodiment can be obtained.

Also in the present embodiment, since the first sub-reflection region 330Aa1 is disposed at a position where it intersects with the horizontal plane P1 including the side end edge 322*a*1 of the light-emitting surface 322*a* of the first light-emitting element 322, which is a first side end edge located on the side opposite to the first sub-reflection region 330Aa1 in the right and left directions, the light distribution pattern PL3*a* having the clear horizontal cutoff line CL1 can be formed as a light distribution pattern having a small vertical width by reflectively controlling the light emitted from the first light-emitting element 322 at the first sub-reflection region 330Aa1.

Similarly, since the second sub-reflection region 330Aa2 is disposed at a position where it intersects with the inclined plane P2 including the side end edge 322*a*2 of the light-emitting surface 322*a* of the first light-emitting element 322, which is a second side end edge located on the side opposite to the second sub-reflection region 330Aa2 in the right and left directions, the light distribution pattern PL3*b* having the clear horizontal cutoff line CL2 can be faulted as a light distribution pattern having a small vertical width by reflectively controlling the light emitted from the first light-emitting element 322 at the second sub-reflection region 330Aa2.

Then, as described above, by forming the light distribution pattern PL3*a* having the clear horizontal cutoff line CL1 and the light distribution pattern PL3*b* having the clear oblique cutoff line CL2 as the light distribution pattern having a small vertical width, it is possible to previously prevent the front region of the low-beam light distribution pattern PL3 from becoming excessively bright. Thus, the forward visibility can be improved.

Also in the present embodiment, the light-emitting surface 322*a* of the first light-emitting element 322 has an outer shape that is longer in the right and left directions than in the front and rear directions. Therefore, similar to the first embodiment, the brightness of the light distribution patterns PL3*a*, PL3*b* can be increased and the front region of the low-beam light distribution pattern PL3 can be prevented from becoming excessively bright.

Also in the present embodiment, the light-emitting surface 324*a* of the second light-emitting element 324 has the normal direction that is oriented in a direction closer to a horizontal direction than the normal direction of the light-emitting surface 322*a* of the first light-emitting element 322. Therefore, it is possible to easily secure, in the reflecting surface 330*a* of the reflector 330, the second reflection region 330Ba on which light emitted from the first light-emitting element 322 is not incident and light emitted from the second light-emitting element 324 is incident.

Particularly in the present embodiment, the spot-like bright light distribution pattern PH3*e* with a narrow vertical width around the H-V can be formed by the light emitted from the second light-emitting element 324 and reflected at the sixth sub-reflection region 30Aa6. Therefore, the center luminous intensity of the high-beam light distribution pattern PH3 can be further enhanced.

At that time, the reason why the light distribution pattern PH3*e* is formed as the spot-like light distribution pattern PH3*e* with the narrow vertical width is that the second light-emitting element 324 has the light-emitting surface 324*a* that is long in the right and left directions and the sixth sub-reflection region 30Aa6 is disposed at a position considerably far away from and obliquely downward and forward from the second light-emitting element 324. Further, the reason why the light distribution pattern PH3*e* is formed as the bright light distribution pattern is that the sixth sub-reflection region 30Aa6 is located in a direction close to the normal direction of the light-emitting surface 324*a* of the second light-emitting element 324.

Also in the present embodiment, the first and second sub-reflection regions 330Aa1, 330Aa2 are disposed on opposite sides in the right and left directions with respect to the first light-emitting element 322, and thus, the shape of the reflector 330 can be easily formed into a shape close to a bilaterally symmetrical shape. Therefore, as a configuration of a vehicle lamp disposed at a right front end portion of a vehicle, it is possible to adopt a configuration in which only the outer shape of the reflector 330 is reversed left and right, and then, the configuration of the vehicle lamp 310 is translated as it is.

Also in the present embodiment, the light-emitting surface 322*a* of the first light-emitting element 322 has an outer shape that is longer in the right and left directions than in the front and rear directions. Therefore, as in the case of the first embodiment, the brightness of the light distribution pattern PL3*a*, PL3*b* can be increased and the front region of the low-beam light distribution pattern PL3 can be prevented from becoming excessively bright.

Meanwhile, the numerical values represented as the specifications in each of the above embodiments and its modifications are merely examples, and it goes without saying that these values may be appropriately set to different values.

Further, the present invention is not limited to the configurations described in each of the above embodiments and its modifications, and it is possible to adopt a configuration with various other modifications.

The present application appropriately incorporates the disclosure content of Japanese Patent Application (Patent Application No. 2014-187409) filed on Sep. 16, 2014 and the disclosure content of Japanese Patent Application (Patent Application No. 2014-187410) filed on Sep. 16, 2014.

What is claimed is:

1. A vehicle lamp configured to be able to selectively perform low-beam irradiation and high-beam irradiation, the vehicle lamp comprising:

first and second light-emitting elements; and a reflector for reflecting light emitted from these first and second light-emitting elements toward a front, wherein a reflecting surface of the reflector has a first reflection region on which light emitted from the first light-emitting element and the second light-emitting element is incident and a second reflection region on which light emitted from the first light-emitting element is not incident but light emitted from the second light-emitting element is incident, and wherein a low-beam light distribution pattern having horizontal and oblique cutoff lines is formed by turning on the first light-emitting element, and a high-beam light distribution pattern is formed by turning on the second light-emitting element or simultaneously turning on the first and second light-emitting elements.

2. The vehicle lamp according to claim 1, wherein the first reflection region has a first sub-reflection region for forming the horizontal cutoff line and a second sub-reflection region for forming the oblique cutoff line, wherein the first sub-reflection region and the second sub-reflection region disposed at positions displaced in right and left directions with respect to the first light-emitting element, wherein a light-emitting surface of the first light-emitting element has a first side end edge located on a side opposite to the first sub-reflection region in the right and left directions, and a second side end edge located on a side opposite to the second sub-reflection region in the right and left directions, wherein the first side end edge and the second side end edge are formed so as to extend in front and rear directions, wherein the first sub-reflection region is disposed at a position where it intersects with a horizontal plane including the first side end edge, and wherein the second sub-reflection region is disposed at a position where it intersects with an inclined plane including the second side end edge and inclined downward or upward at a rising angle of the oblique cutoff line with respect to the horizontal plane.

3. The vehicle lamp according to claim 1, wherein a light-emitting surface of the first light-emitting element has an outer shape that is longer in the right and left directions than in the front and rear directions.

4. The vehicle lamp according to claim 1, wherein a light-emitting surface of the second light-emitting element has the normal direction that is oriented in a direction closer to a horizontal direction than the normal direction of the light-emitting surface of the first light-emitting element.

5. The vehicle lamp according to claim 4, wherein the light-emitting surface of the second light-emitting element has an outer shape that is longer in a direction orthogonal to the front and rear directions than in the front and rear directions.

6. A vehicle lamp configured to form a low-beam light distribution pattern having horizontal and oblique cutoff lines by reflecting light emitted from a light-emitting element toward a front by a reflector, wherein a reflecting surface of the reflector has a first sub-reflection region for forming the horizontal cutoff line and a second sub-reflection region for forming the oblique cutoff line, wherein the first sub-reflection region and the second sub-reflection region are disposed at positions displaced in right and left directions with respect to the light-emitting element, wherein a light-emitting surface of the light-emitting element has a first side end edge located on a side opposite to the first sub-reflection region in the right and left directions and a second side end edge located on a side opposite to the second sub-reflection region in the right and left directions, wherein the first side end edge and the second side end edge are formed so as to extend in front and rear directions, wherein the second sub-reflection region is disposed at a position where it intersects with an inclined plane including the second side end edge and inclined downward or upward at a rising angle of the oblique cutoff line with respect to the horizontal plane, and wherein the light-emitting surface has an outer shape that is longer in the right and left directions than in the front and rear directions.

7. The vehicle lamp according to claim 6, wherein the first and second sub-reflection regions are disposed on a same side in the right and left directions with respect to the light-emitting element, wherein the light-emitting element is disposed in a state where the light-emitting surface is inclined at an angle larger than the rising angle of the oblique cutoff line on a side of the first and second sub-reflection regions with respect to a vertically upward direction, and wherein the second sub-reflection region is disposed at a position where it intersects with the inclined plane inclined downward.

8. The vehicle lamp according to claim 6, wherein the first and second sub-reflection regions are disposed on a same side in the right and left directions with respect to the light-emitting element, wherein the light-emitting element is disposed in a state where the light-emitting surface is inclined at an angle smaller than the rising angle of the oblique cutoff line on a side of the first and second sub-reflection regions with respect to a vertically upward direction, and wherein the second sub-reflection region is disposed at a position where it intersects with the inclined plane inclined upward.

9. The vehicle lamp according to claim 6, wherein the first and second sub-reflection regions are disposed on opposite sides in the right and left directions with respect to the light-emitting element, wherein the light-emitting element is disposed in a state where the light-emitting surface faces upward, and wherein the second sub-reflection region is disposed at a position where it intersects with the inclined plane inclined upward.

10. The vehicle lamp according to claim 6, wherein the first and second sub-reflection regions are disposed on opposite sides in the right and left directions with respect to the light-emitting element, wherein the light-emitting element is disposed in a state where the light-emitting surface faces downward, and wherein the second sub-reflection region is disposed at a position where it intersects with the inclined plane inclined downward.

* * * * *